US005353770A

United States Patent [19]

Osanai et al.

[11] Patent Number: 5,353,770

[45] Date of Patent: Oct. 11, 1994

[54] APPARATUS FOR CONTROLLING FLOW OF EVAPORATED FUEL FROM CANISTER TO INTAKE PASSAGE OF ENGINE USING PURGE CONTROL VALVES

[75] Inventors: Akinori Osanai; Takaaki Itoh; Yoshihiko Hyodo; Toru Kidokoro, all of Susono, Japan

[73] Assignee: Toyota Jidosha Kabushiki Kaisha, Aichi, Japan

[21] Appl. No.: 63,080

[22] Filed: May 18, 1993

[30] Foreign Application Priority Data

May 21, 1992 [JP] Japan ..... 4-129077
Jun. 1, 1992 [JP] Japan ..... 4-140711
Jun. 26, 1992 [JP] Japan ..... 4-169433

[51] Int. Cl.[5] ..... F02M 33/02
[52] U.S. Cl. ..... 123/520
[58] Field of Search ..... 123/516, 518, 519, 520

[56] References Cited

U.S. PATENT DOCUMENTS 5,060,621 10/1991 Cook et al. ..... 123/520
5,103,794 4/1992 Shiraishi ..... 123/520
5,237,979 8/1993 Hyodo et al. ..... 123/520

FOREIGN PATENT DOCUMENTS 57-97117 6/1982 Japan .
58-174773 10/1983 Japan .
59-167702 9/1984 Japan .
60-252901 12/1985 Japan .
61-105601 5/1986 Japan .
62-233466 10/1987 Japan .

*Primary Examiner*—E. Rollins Cross
*Assistant Examiner*—Thomas N. Moulis

[57] ABSTRACT

An apparatus for controlling a flow of evaporated fuel from a canister being fed into an intake passage of an engine through a plurality of control valves arranged in parallel in a purge passage between the canister and the intake passage. The plurality of control valves includes at least a first valve being switched on and off by setting a control factor indicating a duty ratio of an on-time within a duty cycle to a total duty-cycle time for the first valve, and a second valve being switched on and off by setting a control factor indicating an on-state or off-state of the second valve for a total duty-cycle time. The apparatus includes a first control part for setting a first control factor for the first valve so that the first valve is switched on at a rate indicated by the first control factor, and a second control part for setting a second control factor for the second valve so that the second valve is switched on and off at a timing different from a timing at which the first valve is switched on and off.

18 Claims, 24 Drawing Sheets

MAX PURGE RATIO "MAXPG" (%)

| NE \ Q/N | 0.15 | 0.30 | 0.45 | 0.60 | 0.75 | 0.90 | 1.05 | 1.20 | 1.35 | 1.50 | 1.65 | |
|---|---|---|---|---|---|---|---|---|---|---|---|---|
| 400 | 25.6 | 25.6 | 21.6 | 15.0 | 11.4 | 8.6 | 6.3 | 4.3 | 2.8 | 0.8 | 0 | |
| 800 | 25.6 | 16.3 | 10.8 | 7.5 | 5.7 | 4.3 | 3.1 | 2.1 | 1.4 | 0.4 | 0 | |
| 1600 | 16.6 | 8.3 | 5.5 | 3.7 | 2.8 | 2.1 | 1.5 | 1.2 | 0.9 | 0.3 | 0 | |
| 2400 | 10.6 | 5.3 | 3.5 | 2.4 | 1.8 | 1.4 | 1.1 | 0.8 | 0.6 | 0.3 | 0.1 | |
| 3200 | 7.8 | 3.9 | 2.6 | 1.8 | 1.4 | 1.1 | 0.9 | 0.6 | 0.5 | 0.4 | 0.2 | |
| 4000 | 6.4 | 3.2 | 2.1 | 1.5 | 1.2 | 0.9 | 0.7 | 0.6 | 0.4 | 0.4 | 0.3 | |

Q/N = ℓ / REV
NE = RPM

FIG.21A
FIG.21B
FIG.21C
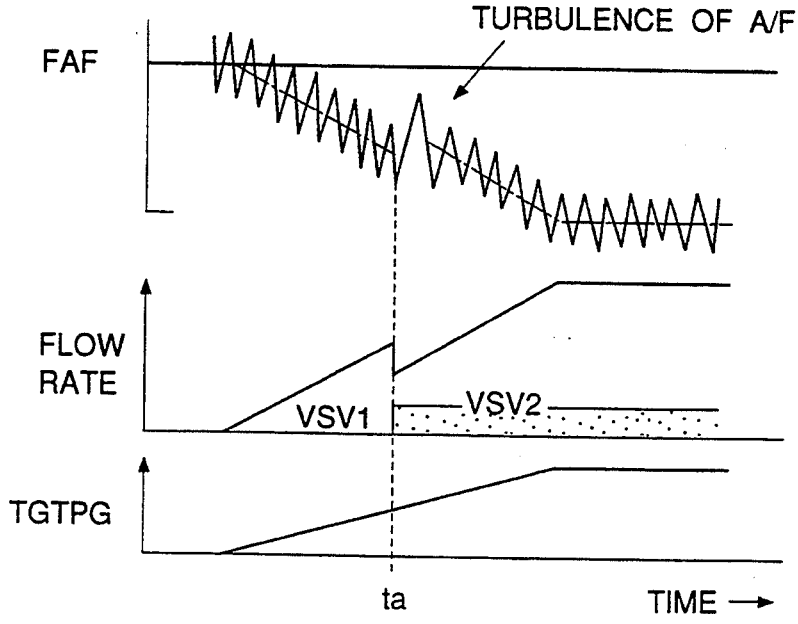
FIG.22
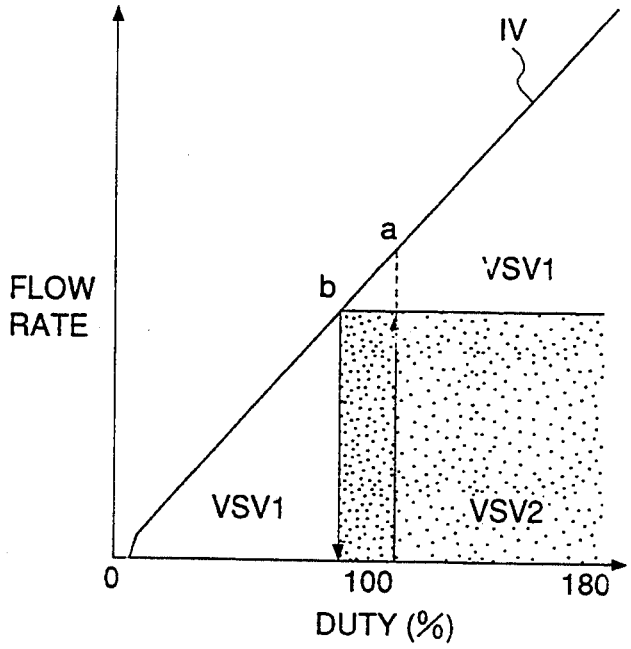

APPARATUS FOR CONTROLLING FLOW OF EVAPORATED FUEL FROM CANISTER TO INTAKE PASSAGE OF ENGINE USING PURGE CONTROL VALVES

BACKGROUND OF THE INVENTION (1) Field of the Invention

The present invention generally relates to an evaporated fuel purge control apparatus, and more particularly to an evaporated fuel purge control apparatus for an internal combustion engine in which the flow of evaporated fuel being fed from a canister into an intake passage of the engine is controlled using a plurality of purge control valves arranged in parallel in a passage between the canister and the intake passage.

(2) Description of the Related Art

In an internal combustion engine, an evaporated fuel purge control system is provided. In this evaporated fuel purge control system, evaporated fuel from a fuel tank is stored in a canister, and the stored fuel is fed from the canister to an intake passage of the engine through a purge control valve arranged in a passage between the canister and the intake passage. The flow of evaporated fuel from the canister to the intake passage is controlled by the purge control valve under prescribed operating conditions of the engine.

Certain types of the evaporated fuel purge control systems have been proposed in which two purge control valves are arranged in parallel in a passage between a canister and an intake passage. For example, Japanese Laid-Open Patent Publication No. 62-233466 discloses an evaporated fuel purge system of this type. In the system of this publication, a master control valve and a slave control valve are arranged in parallel in order to supply a suitable amount of evaporated fuel to the intake passage at a suitable timing. Also, there has been proposed an evaporated fuel purge control apparatus in which a duty cycle control valve is provided in order to accurately control the flow of the evaporated fuel into the intake passage.

However, if an evaporated fuel purge control apparatus including a plurality of purge control valves arranged in parallel in a passage between the canister and the intake passage is provided in an internal combustion engine, the engine will be subjected to a pulsating flow of evaporated fuel being fed into the intake passage because the valves are opened and closed at duty cycles and phases which are equal to each other. Also, it is likely that the evaporated fuel is supplied to only a specific cylinder of the engine, and the turbulence of the air fuel ratio will occur in the engine.

In addition, Japanese Laid-Open Patent Publication No. 61-105601 discloses a pulse width modulation (PWM) fluid flow controlling method. In this method, the switching operations of two solenoid valves arranged in parallel are controlled using PWM signals having the duty cycle equal to each other and having the same phase so as to drive an actuator by the flow of operating fluid.

However, in the conventional method disclosed in the above mentioned publication, there is a problem in that the number of switching operations of the two control valves is relatively large. Therefore, an evaporated fuel purge control apparatus with a plurality of purge control valves to which the above method is applied will be noisy and less durable.

SUMMARY OF THE INVENTION

Accordingly, it is a general object of the present invention to provide an improved evaporated fuel purge control apparatus in which the above described problems are eliminated.

Another and more specific object of the present invention is to provide an evaporated fuel purge control apparatus which ensures an accurate and stable flow of evaporated fuel being fed into an intake passage of an engine in which the increase of the pulsating flow of the evaporated fuel and the turbulence of the air-fuel ratio are eliminated. The above mentioned objects of the present invention are achieved by an evaporated fuel purge control apparatus which includes a plurality of purge control valves arranged in parallel in a purge passage between a canister and an intake passage, the plurality of purge control valves including a first valve switched on and off based on a control factor, the control factor includes a driving duty ratio value indicating an on-time within a duty cycle of a total duty-cycle time for the first valve, and a second valve being switched on and off based on a control factor indicating an on-state or off-state of the second valve for a total duty-cycle time, a first control part for setting a first control factor for the first valve so that the first valve is switched on at a rate indicated by the first control factor, and a second control part for setting a second control factor for the second valve so that the second valve is switched on and off at a timing different from a timing at which the first valve is switched on and off.

According to the present invention, it is possible to prevent the increase of the pulsating flow of evaporated fuel being fed into the intake passage through uniquely switching-controlled operations of the first and second valves. Also, it is possible to prevent the evaporated fuel from being supplied to only a specific cylinder of the engine, thus eliminating the occurrence of the turbulence of the air-fuel ratio.

Other objects and further features of the present invention will be apparent from the following detailed description when read in conjunction with the accompanying drawings.

BRIEF DESCRIPTION OF THE DRAWINGS

FIGS. 21A, 21B and 21C are timing charts showing the changes of an air-fuel ratio feedback factor, the flow rate and a target purge ratio when the purge control process shown in FIG. 18 is performed;

FIG. 22 is a chart for explaining the relationship between the valve switching operations and the duty ratio changes;

DESCRIPTION OF THE PREFERRED EMBODIMENTS

Figure 1:
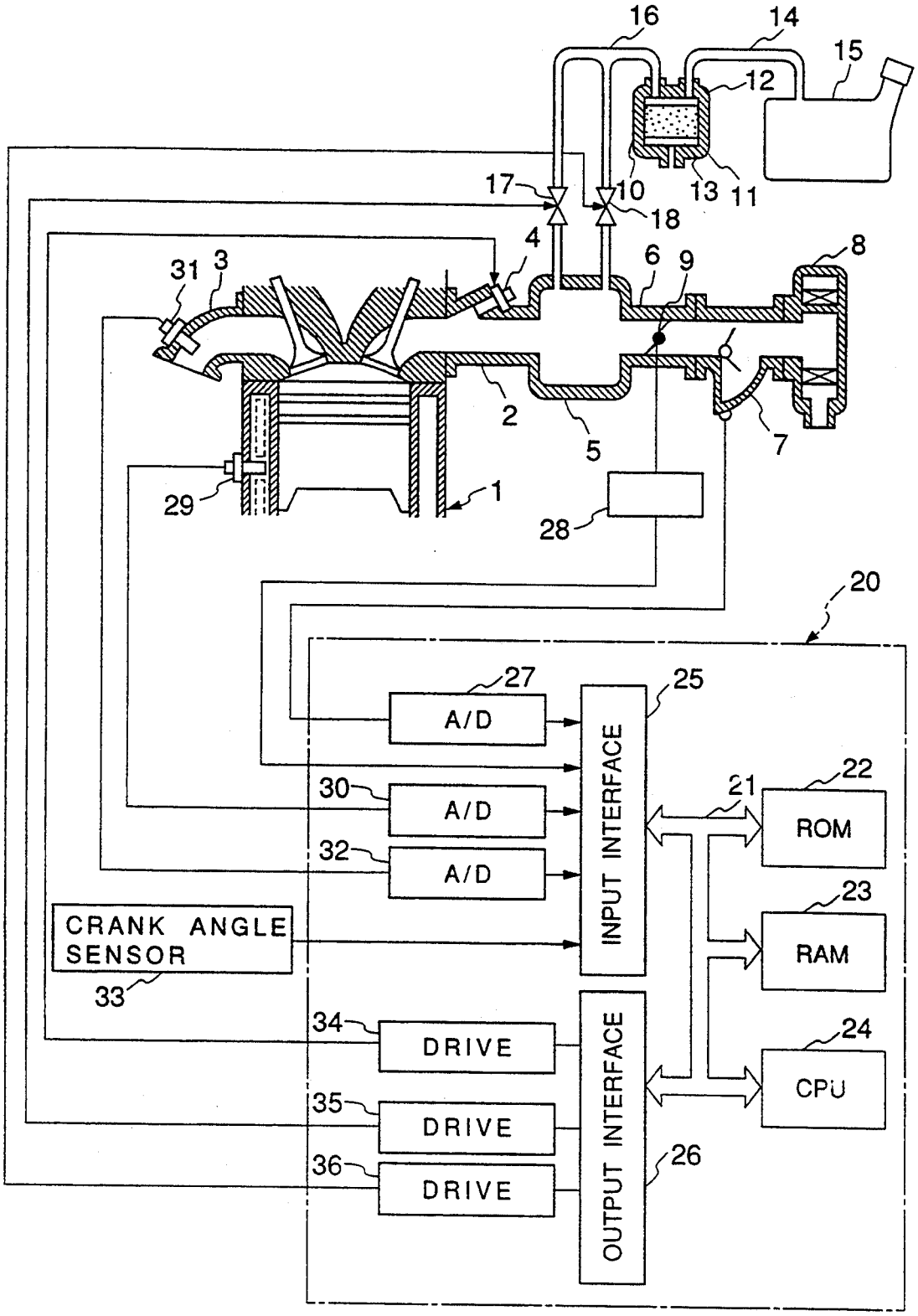
FIG. 1 is a system diagram showing an internal combustion engine to which an evaporated fuel purge control apparatus according to the present invention is applied.

A description will now be given of an internal combustion engine to which the present invention is applied, with reference to FIG. 1. FIG. 1 shows an internal combustion engine 1 in which an evaporated fuel purge apparatus according to the present invention is provided. The internal combustion engine 1 has four cylinders; only one cylinder of the engine is shown in FIG. 1, the other cylinders being omitted for the sake of convenience.

In the internal combustion engine 1 shown in FIG. 1, an intake pipe 2 is connected to an inlet port of each of the cylinders. An exhaust manifold 3 is provided at outlet ports of the cylinders of the engine. Also, a fuel injection valve 4 is provided in the intake pipe 2 so as to inject fuel to the engine 1.

The intake pipe 2 is connected to a surge tank 5, and the surge tank 5 is connected to an air cleaner 8 via an intake duct 6. An air flow meter 7 is provided at an intermediate portion between the surge tank 5 and the air cleaner 8. A throttle valve 9 for controlling the flow of intake air into the inlet ports of the engine is provided within the intake duct 6.

A canister 11 including activated carbon 10 for adsorbing evaporated fuel from a fuel tank 15 is provided in the engine 1. The canister 11 has a fuel vapor chamber 12 provided above the activated carbon 10 and an air chamber 13 provided below the activated carbon 10 and leading to the atmosphere via an opening on the bottom of the canister 11. The fuel vapor chamber 12 of the canister 11 is connected to the fuel tank 15 via a vapor passage 14. The fuel vapor chamber 12 of the canister 11 is also connected to the surge tank 5 via a purge passage 16. This purge passage 16 has two branch passages, and two purge control valves 17 and 18 are provided at intermediate portions of the branch passages. Each of the purge control valves 17 and 18 is a vacuum switching valve (VSV) which can be switched on and off (or opened and closed) by inputting a control signal to the VSV. Hereinafter, the purge control valves 17 and 18 are also indicated as VSV1 and VSV2, respectively.

The engine 1 shown in FIG. 1 is provided with an electronic control unit (ECU) 20. The operations of the purge control valves 17 and 18 are controlled by inputting signals from the ECU 20 to the valves 17 and 18. Evaporated fuel in the fuel tank 15 is supplied to the canister 11 via the vapor passage 14, and the evaporated fuel is adsorbed by the activated carbon 10 of the canister 11. If the purge control valves 17 and 18 are opened by the output signals of the ECU 20, external air is fed from the air chamber 13 of the canister 11 to the purge passage 16 via the activated carbon 10. When the external air passes through the activated carbon 10, the evaporated fuel is desorbed from the activated carbon 10, and the mixture of air and evaporated fuel (or fuel vapor) is fed from the canister 11 to the surge tank 5 (or the intake passage of the engine) via the purge passage 16.

The electronic control unit (ECU) 20 shown in FIG. 1 is made up of a digital computer. The ECU 20 has a read only memory (ROM) 22, a random access memory (RAM) 23, a central processing unit (CPU) or microprocessor 24, an input interface circuit 25, and an output interface circuit 26, and these components of the ECU 20 are interconnected by a bi-directional bus 21.

The air flow meter 7 outputs a signal indicating a flow rate of intake air, and this signal is supplied to an analog-to-digital converter (A/D) 27. The A/D converter 27 converts the signal supplied from the air flow meter 7 into a digital signal, and this signal is supplied to the input interface circuit 25. A throttle switch 28 is provided in the throttle valve 9. When the throttle valve 9 is positioned at an idling position, the throttle switch 28 is turned ON and a digital signal is supplied from the throttle switch 28 to the input interface circuit 25. In the engine 1, a water temperature sensor 29 is provided, and a signal indicating the engine cooling water temperature is supplied to the input interface circuit 25 via an A/D converter 30. In the exhaust manifold 3, an oxygen sensor 31 is provided, and a signal output by the oxygen sensor 31 is supplied to the input interface circuit 25 via an A/D converter 32. The operation of the A/D converters 30 and 32 are essentially the same as that of the A/D converter 27. A crank angle sensor 33 is connected to the input interface circuit 25, and the crank angle sensor 33 outputs a pulse signal each time a crankshaft of the engine is rotated by 30 degrees. In the CPU 24, an engine speed (revolutions per minute) is calculated based on the signal supplied from the crank angle sensor 33.

Three driving circuits 34, 35 and 36 are connected to the output interface circuit 26. Control signals which are supplied from the CPU 24 via the output interface circuit 26 are supplied from the driving circuits 34, 35 and 36 to the fuel injection valve 4, the purge control valve 17 and the purge control valve 18, respectively.

Figure 3:
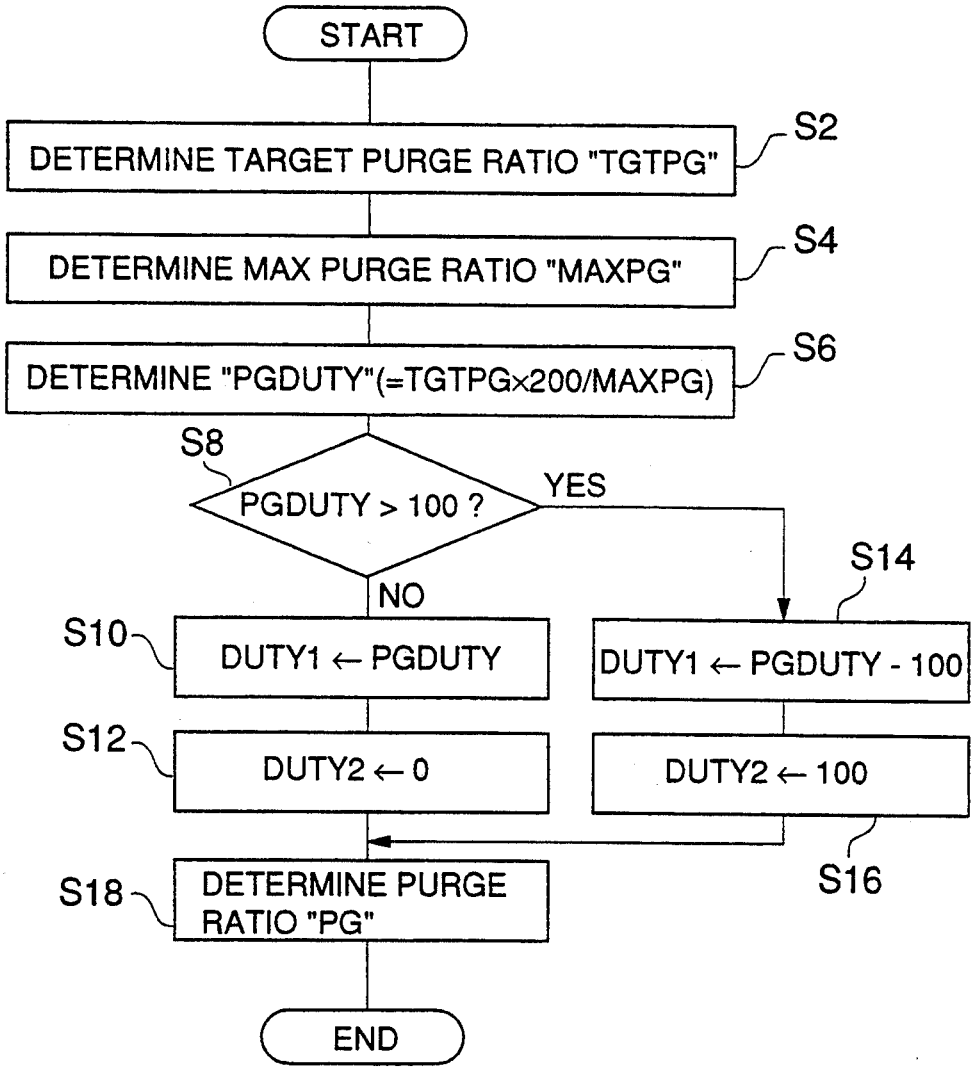
FIG. 3 is a flowchart for explaining a purge control process provided in the first embodiment of the present invention.

Next, a description will be given of an evaporated fuel purge control process provided in a first embodiment of the present invention. FIG. 3 shows a purge control process which is repeatedly performed by the ECU 20 per 100 milli-seconds (ms). This time period at which the valve switching operation is performed is hereinafter called a duty cycle.

In the purge control process shown in FIG. 3, step S2 determines a target purge ratio (TGTPG) by adding a prescribed purge changing ratio (A) to a previous purge ratio (PG) previously determined in the purge control process (TGTPG=PG+A). Step S4 determines a maximum purge ratio (MAXPG) in accordance with the engine speed (NE) and the intake air amount (Q/N) per revolution of the engine crankshaft. This maximum purge ratio (MAXPG) is determined by retrieving a map stored in the ROM 22. The value of the MAXPG corresponds to the maximum flow rate of evaporated fuel being fed into the intake passage.

Step S6 determines a driving duty ratio (PGDUTY) from the target purge ratio (TGTPG) and the maximum purge ratio (MAXPG) in accordance with the following equation.

$$PGDUTY = TGTPG \times 200/MAXPG \quad (1)$$

It is apparent from the equation (1) that the maximum value of the driving duty cycle (PGDUTY) is equal to 200 (%).

Step S8 detects whether or not the value of the driving duty ratio PGDUTY determined in step S6 is greater than 100 (%). If PGDUTY>100, step S10 is performed. In this step S10, the value of the PGDUTY is set to a first duty ratio DUTY1 provided for the purge control valve 17. Also, step S12 sets zero to a second duty ratio DUTY2 provided for the purge control valve 18. If PGDUTY>100, step S14 is performed. In this step S14, the value of (PGDUTY−100) is set to the first duty ratio DUTY1. Also, step S16 sets 100 (%) to the second duty ratio DUTY2.

After step S12 or step S16 is performed, step S18 determines the purge ratio PG (expressed in percent %) in accordance with the following equation.

$$PG = MAXPG \times PGDUTY/200 \quad (2)$$

After step S18 is performed, the purge control process ends.

Figure 4:
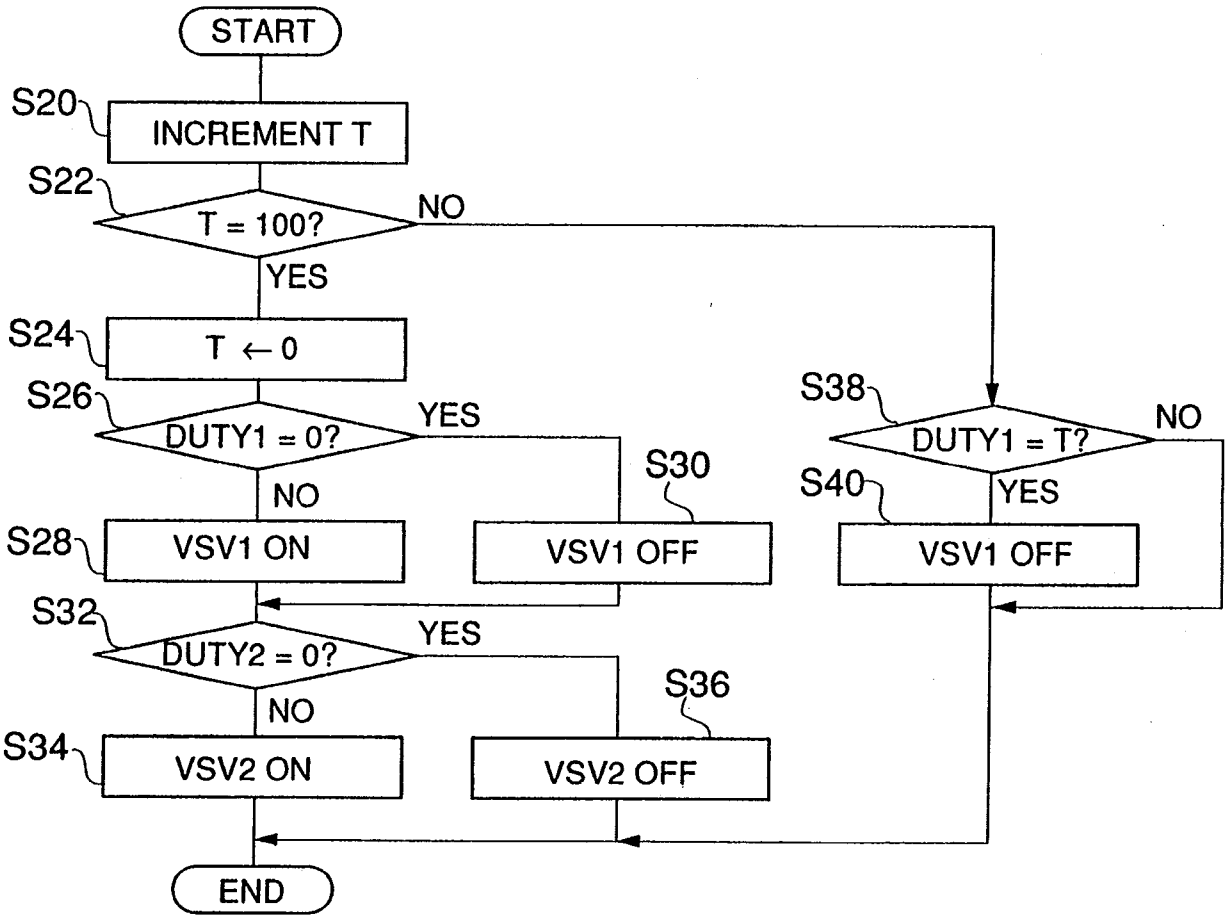
FIG. 4 is a flowchart for explaining a valve switching process provided in the first embodiment of the present invention.

FIG. 4 shows a valve switching process which is repeatedly performed by the ECU 20 per 1 milli-second (ms), for example. In the valve switching process shown in FIG. 4, step S20 increments a timer count (T) (T←T+1). Step S22 detects whether or not the value of the timer count T is equal to 100. If T=100, step S24 resets the timer count T to zero. If the value of the timer count T is not equal to 100, step S38 (which will be described later) is performed.

Step S26 detects whether or not the value of the first duty ratio DUTY1 provided for the purge control valve 17 (VSV1) is equal to 0. If DUTY1=0, step S30 switches the purge control valve 17 OFF. If the value of the first duty ratio DUTY1 is not equal to 0, step S28 switches the purge control valve 17 ON.

Step S32 detects whether or not the value of the second duty ratio DUTY2 provided for the purge control valve 18 (VSV2) is equal to 0. If DUTY2=0, step S36 switches the purge control valve 18 OFF. If the value of the second duty ratio DUTY2 is not equal to 0, step S34 switches the purge control valve 18 ON. Then, the valve switching process ends.

If the value of the timer count (T) is not equal to 100 in step S22, step S38 detects whether or not the value of the first duty ratio DUTY1 is equal to the value of the timer count T. If DUTY1=T, step S40 switches the purge control valve 17 OFF. If the value of the first duty ratio DUTY1 is not equal to the value of the timer count T, the valve switching process ends without switching the purge control valve 17 OFF.

Figures 5A, 5B:
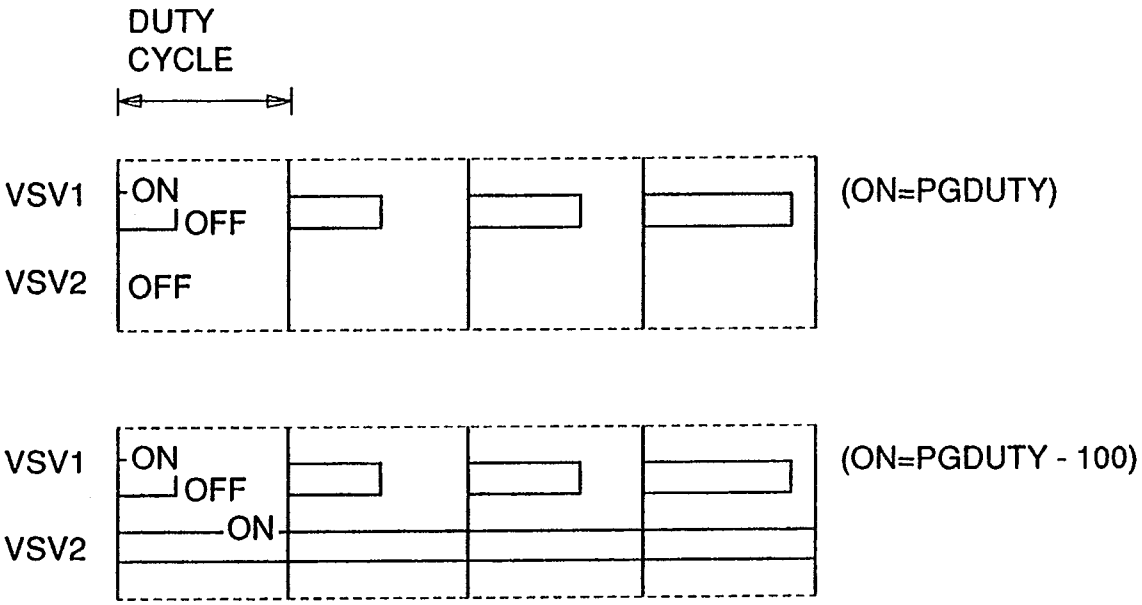
FIGS. 5A and 5B are timing charts showing the switching operations of two purge control valves provided in the first embodiment.

In the first embodiment mentioned above, the switching operations of the purge control valves 17 (VSV1) and 18 (VSV2) are carried out, as shown in FIGS. 5A and 5B, by performing the purge control process in FIG. 3 and the valve switching process in FIG. 4. That is, if the driving duty ratio PGDUTY is smaller than 100, the valve 17 is switched ON during an on-time indicated by the PGDUTY within a duty cycle of 100 ms constant and switched OFF during the remaining time period of the duty cycle, and the valve 18 is switched OFF during a total duty-cycle time as shown in FIG. 5A. If the driving duty ratio PGDUTY is greater than 100, the valve 17 is switched ON during an on-time indicated by the value of (PGDUTY−100) within a duty cycle of 100 ms and switched OFF during the remaining time period of the duty cycle, and the valve 18 is continuously switched ON during a total duty-cycle time as shown in FIG. 5B.

The purge control valve 17 (VSV1) is switched 0N and OFF for each duty cycle, but the purge control valve 18 (VSV2) is not always switched. Thus, a vacuum switching valve having a response capability that is somewhat low can be used as the valve 18 (VSV2). Also, the timing at which an ON state of the valve 17 is changed to an OFF state thereof or vice versa is always different from the timing at which an ON state of the valve 18 is changed to an OFF state thereof or vice versa, thus preventing the increase of the pulsating flow of evaporated fuel being fed into the intake passage through the valves 17 and 18. Also, the evaporated fuel from the canister 11 is unlikely to be supplied to only a specific engine cylinder since the switching operations of the valves 17 and 18 arranged in the purge passage 16 between the canister 11 and the intake passage 2 are uniquely controlled, thus preventing the occurrence of the turbulence of the air-fuel ratio.

Figure 6A:
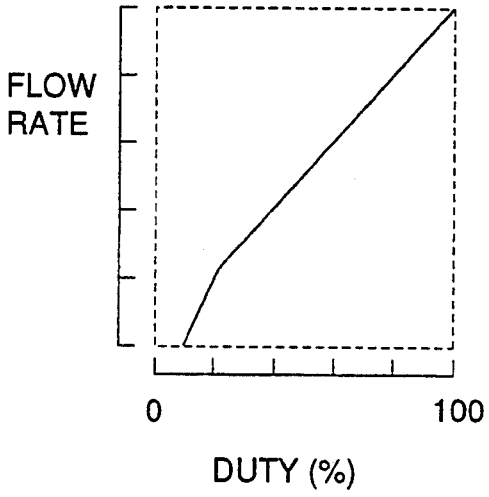
FIGS. 6A, 6B and 6C are charts for explaining the characteristic relationship between a calculated duty ratio and the resulting flow rate.
Figure 6B:
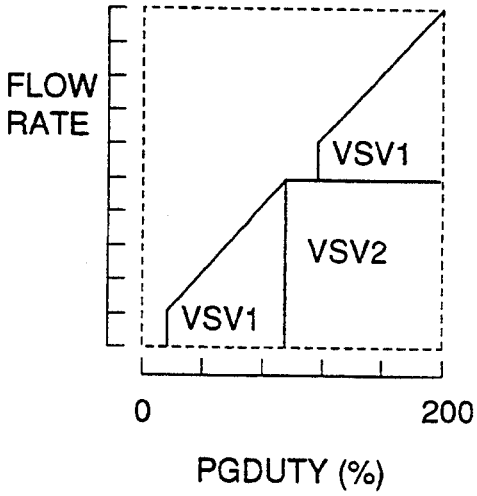

FIG. 6A shows a general relationship between the duty ratio DUTY (indicated by a signal supplied from the ECU 20 to the purge control valve 17) and the flow rate of evaporated fuel (fed from the canister 11 to the intake passage of the engine). As shown in FIG. 6A, when the duty ratio indicated by the signal input to the purge control valve 17 is lower than 20%, the purge control valve 17 is not adequately opened in accordance with the linearity between the duty ratio and the flow rate shown in FIG. 6A. Therefore, in a case of the first embodiment described above, the relationship between the driving duty ratio PGDUTY and the flow rate of the evaporated fuel is as shown in FIG. 6B. Hence, the above described first embodiment has a problem in that the flow rate in response to the PGDUTY become unstable when the value of the PGDUTY is in the ranges between 0% and 20% and between 100% and 120%.

Figure 7:
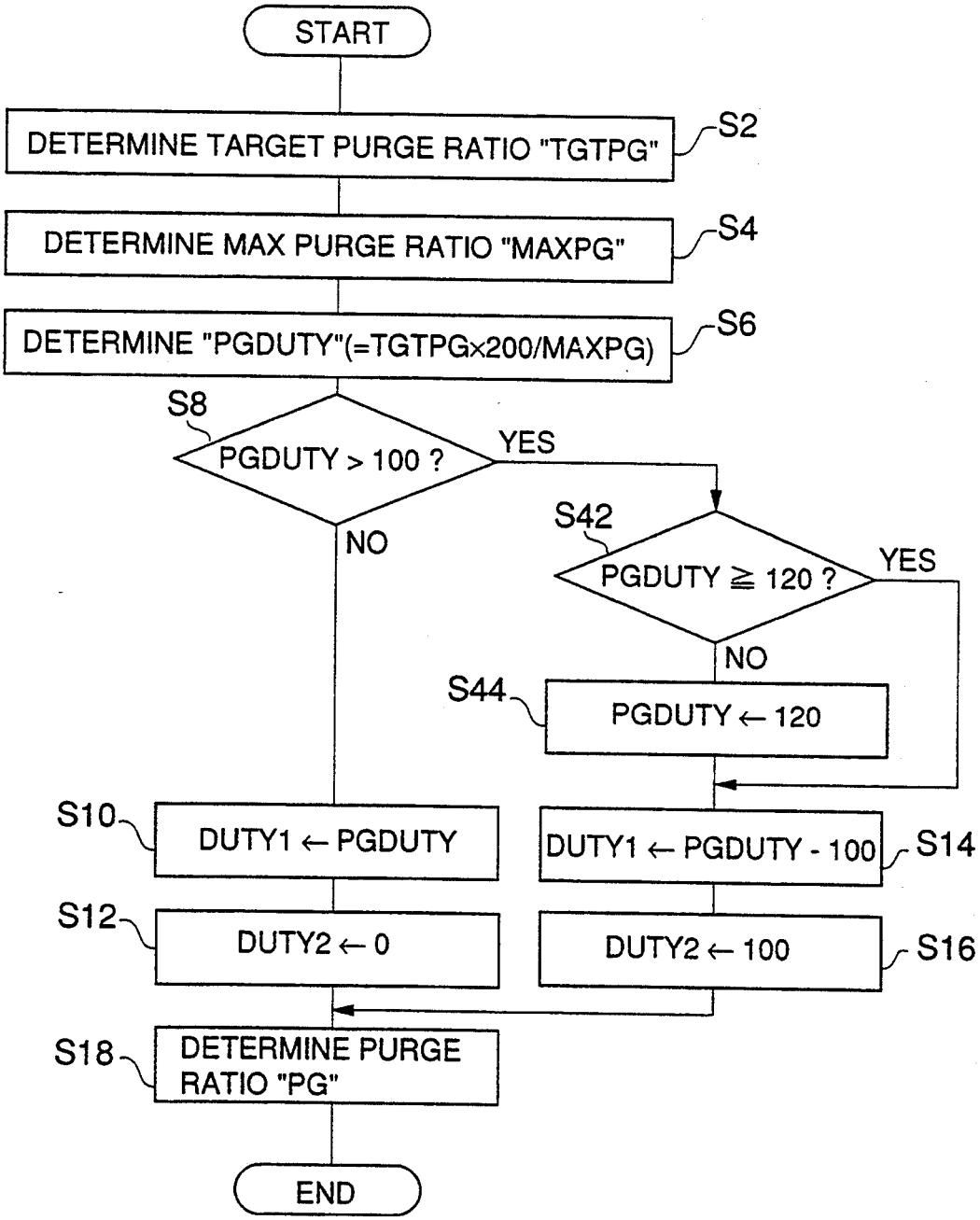
FIGS. 7 and 8 are flowcharts for explaining modified purge control processes which are different from the purge control process shown in FIG. 3.
Figure 8:
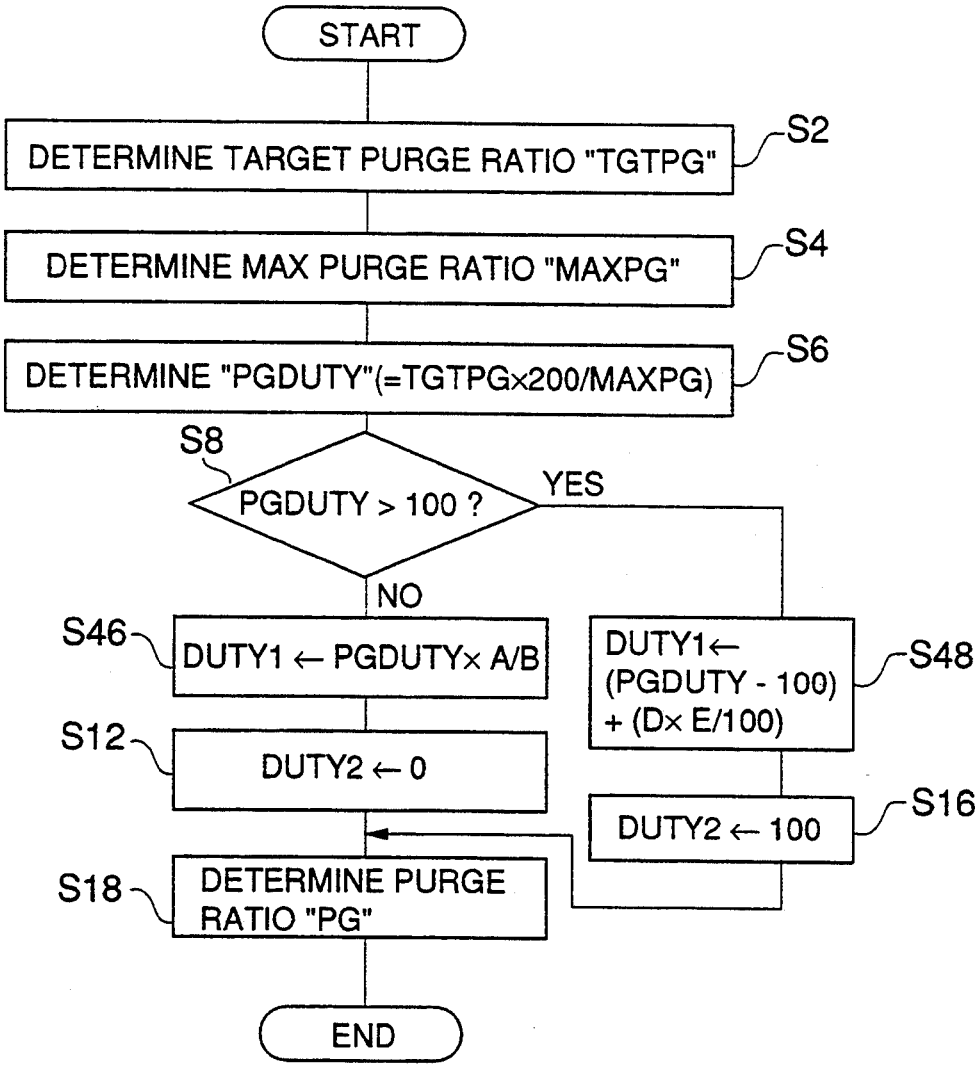

FIGS. 7 and 8 show modified purge control processes which are provided in order to eliminate the setting of the PGDUTY falling in the range between 100% and 120%. In FIGS. 7 and 8, steps which are the same as the corresponding steps shown in FIG. 3 are designated by the same reference numerals, a description thereof being omitted.

In the purge control process shown in FIG. 7, if the value of the PGDUTY is detected as being smaller than 100 (%) in step S8, the above described steps S10, S12 and S18 are performed. If PGDUTY > 100, step S42 is performed. In this step S42, it is detected whether or not the value of the PGDUTY is equal to or greater than 120 (%). If PGDUTY < 120, step S44 sets 120 (%) to the driving duty ratio PGDUTY. If PGDUTY ≧ 120, the above described steps S14 and S16 are performed without performing step S44. Accordingly, when the value of the PGDUTY is in the range between 100% and 120% the PGDUTY is always set to 120 (%), and it is possible to make the flow rate in response to the PGDUTY stable when the PGDUTY is in the range between 100% and 120%.

Figure 6C:
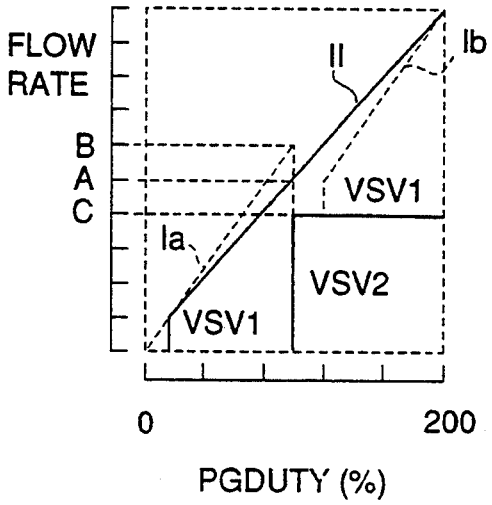

FIG. 8 shows another modified purge control process. In the process shown in FIG. 8, a first flow rate B when the purge control valve 17 is fully opened and a second flow rate C when the purge control valve 18 is fully opened are predetermined such that the first flow rate B is greater than the second flow rate C, and the average A of the first flow rate B and the second flow rate C is predetermined as being equal to (B+C)/2. The flow rates A, B and C mentioned above are indicated in FIG. 6C.

In the process shown in FIG. 8, if the value of the PGDUTY is detected as being smaller than 100 (%) in step S8, step S46 and the above steps S12 and S18 are performed. Step S46 sets the first duty ratio DUTY1 (provided for the purge control valve 17) in accordance with the following equation.

$$DUTY1 = PGDUTY \times A/B$$

If PGDUTY > 100, step S48 and the above step S16 are performed as shown in FIG. 8. Step S48 sets the first duty ratio DUTY1 in accordance with the following equation.

$$DUTY1 = (PGDUTY - 100) + (D \times E/100)$$

where D denotes the value of (A−C/A), and E denotes the value of (200−PGDUTY). By performing the purge control process shown in FIG. 8, it is possible to make the flow rate in response to the PGDUTY stable as indicated by a solid line II in FIG. 6C, and the relationship between the PGDUTY and the flow rate is substantially linear. Dotted lines Ia and Ib in FIG. 6C indicate the relationship between the PGDUTY and the flow rate when the purge control process shown in FIG. 3 is performed.

Figure 9:
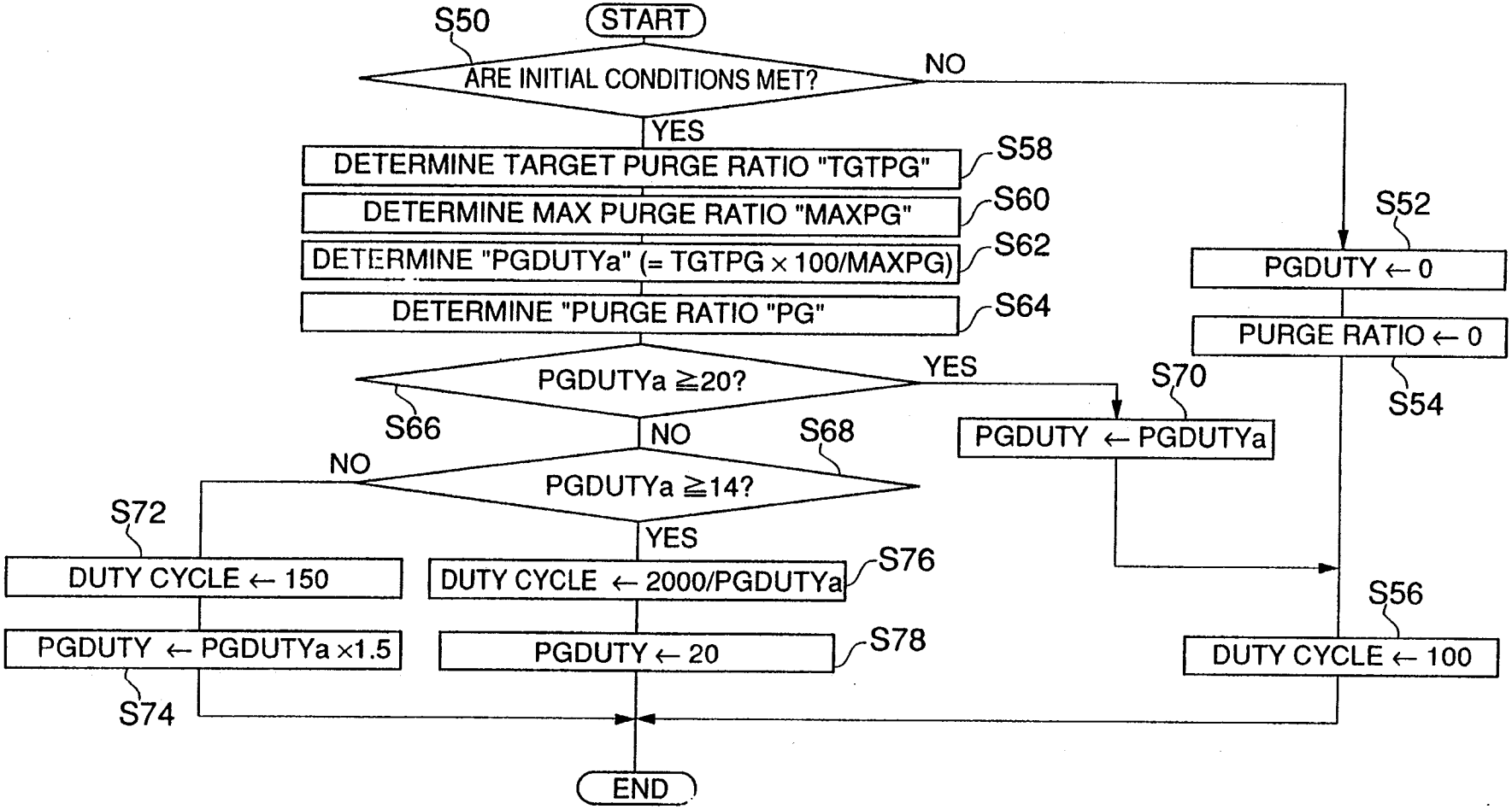
FIG. 9 is a flowchart for explaining a purge control process provided in a second embodiment of the present invention.

Next, a description will be given of a purge control process and a valve switching process provided in a second embodiment of the present invention. FIG. 9 shows the purge control process provided in the second embodiment. This purge control process is repeatedly performed by the ECU 20 at a duty cycle of 100–150 ms. This duty cycle is varied between 100 ms and 150 ms according to a calculated driving duty ratio.

In the purge control process shown in FIG. 9, step S50 detects whether or not the initial conditions are met (i.e., the engine cooling water temperature being higher than a prescribed temperature; and the air-fuel ratio feedback conditions being in conformity with a prescribed requirement). If the initial conditions are not met, step S52 sets zero to a driving duty ratio PGDUTY. Step S54 sets zero to a purge ratio PG. Step S56 sets 100 to a duty cycle, which corresponds to a time period of 100 ms. And, the purge control process ends.

If the initial conditions are met in step S50, step S58 determines a target purge ratio TGTPG by adding a prescribed purge changing ratio A to a previous purge ratio PG previously determined in this process. Step S60 determines a maximum purge ratio MAXPG in accordance with the engine speed NE and the intake air amount Q/N per revolution of the engine crankshaft. This maximum purge ratio MAXPG is determined by retrieving a map stored in the ROM 22. This ratio corresponds to the maximum amount of evaporated fuel being fed by one of the two purge control valves 17 and 18 to the intake passage of the engine.

Step S62 determines a second driving duty ratio PGDUTYa from the target purge ratio (TGTPG) and the maximum purge ratio (MAXPG) in accordance with the following equation.

$$PGDUTYa = TGTPG \times 100/MAXPG \quad (3)$$

It is apparent from the equation (3) that the maximum value of the second driving duty cycle PGDUTYa is equal to 100.

After step S62 is performed, step S64 determines the purge ratio (PG) in accordance with the following equation.

$$PG = MAXPG \times PGDUTY/100 \quad (4)$$

After step S64 is performed, step S66 detects whether or not the value of the second driving duty ratio PGDUTYa determined in step S62 is greater than or equal to 20. Step S68 detects whether or not the value of the second driving duty ratio PGDUTYa is greater than or equal to 14. If the answer to step S66 is affirmative (PGDUTYa ≧ (20), step S70 sets the value of the PGDUTYa to the driving duty ratio PGDUTY, and the above step S56 is performed to set 100 to the duty cycle. And, the purge control process ends.

If both the answers to steps S66 and S68 are negative (PGDUTYa<14), step S72 sets 150 to the duty cycle, which corresponds to a time period of 150 ms. Since the duty cycle is extended to 150 ms, step S74 sets the value of (PGDUTYa×1.5) to the driving duty ratio PGDUTY. And, the purge control process ends.

If the answer to step S66 is negative and the answer to step S68 is affirmative (14≦PGDUTYa<20), step S76 is performed. In this step S76, a duty cycle when the switching of the purge control valves 17 and 18 is controlled for a time period of 20 ms is calculated in accordance with the equation: DUTY CYCLE=2000/PGDUTYa. After step S76 is performed, step S78 sets 20 to the driving duty ratio PGDUTY, which corresponds to the above time period of 20 ms. And, the purge control process ends.

Figure 10:
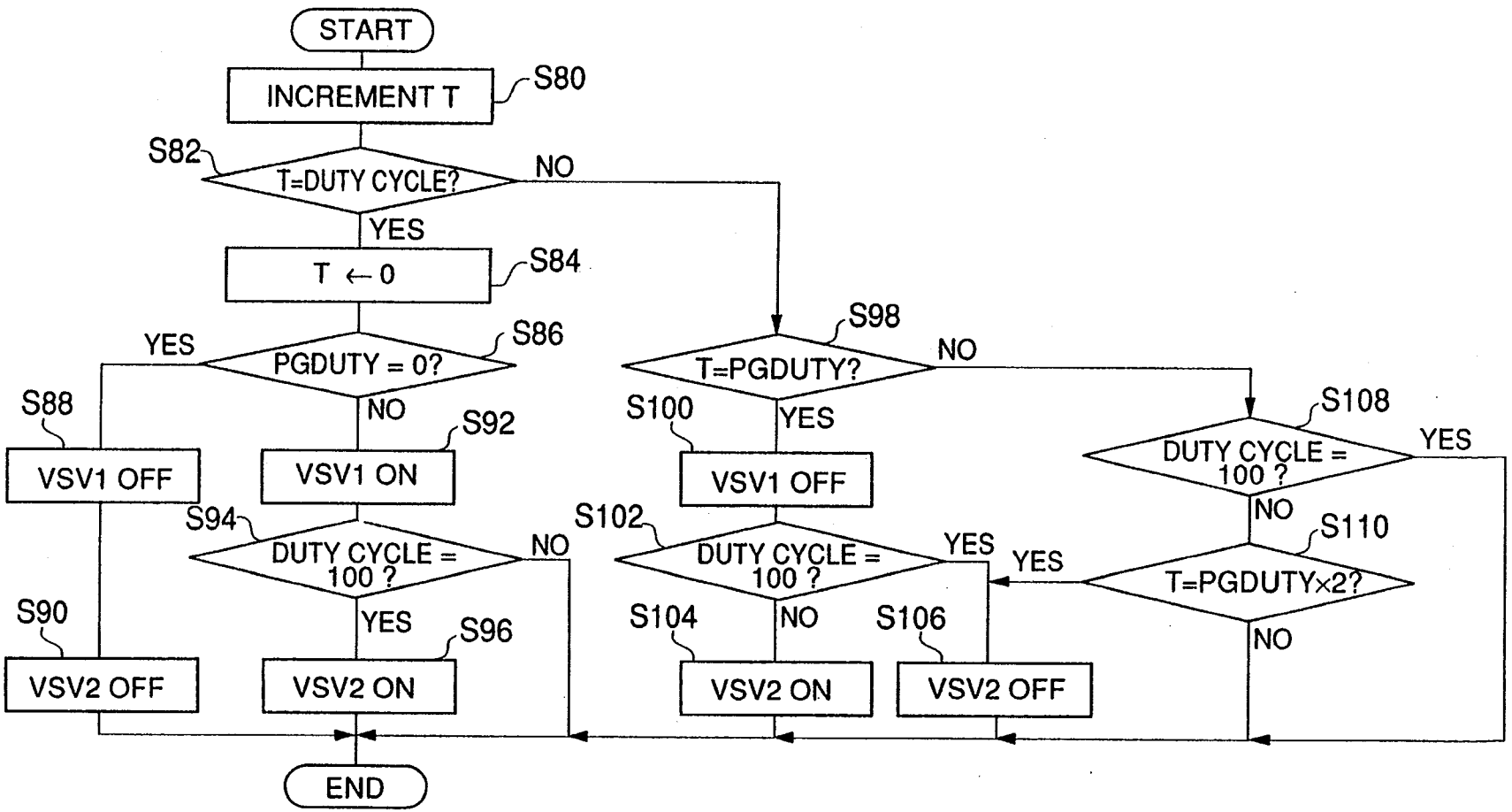
FIG. 10 is a flowchart for explaining a valve switching process provided in the second embodiment of the present invention.

FIG. 10 shows the valve switching process provided in the second embodiment. This process is repeatedly performed by the ECU 20 per 1 ms. In the valve switching process shown in FIG. 10, step S80 increments the timer count T (T←T+1). Step S82 detects whether or not the value of the timer count T is equal to the duty cycle. If the answer to step S82 is affirmative, step S84 resets the timer count T to zero. If the answer to step S82 is negative, step S98 (which will be described later) is performed.

After step S84 is performed, step S86 detects whether or not the value of the driving duty ratio PGDUTY is equal to 0. If PGDUTY=0, step S88 switches the purge control valve 17 (VSV1) OFF, and step S90 switches the purge control valve 18 (VSV2) OFF. Then, the valve switching process ends. If the value of the driving duty ratio PGDUTY is not equal to 0, step S92 switches the purge control valve 17 (VSV1) ON. Step S94 detects whether or not the value of the duty cycle is equal to 100. If the answer to step S94 is affirmative, step S96 switches the purge control valve 18 (VSV2) ON and the valve switching process ends. If the answer to step S94 is negative, the valve switching process ends without performing step S96.

If the answer to step S82 is negative, step S98 detects whether or not the timer count T is equal to the value of the driving duty ratio PGDUTY. If the answer to step S98 is affirmative (T=PGDUTY), step S100 switches the purge control valve 17 (VSV1) OFF. Step S102 detects whether or not the value of the duty cycle is equal to 100. If the answer to step S102 is negative, step S104 switches the purge control valve 18 (VSV2) ON and the process ends. If the answer to step S102 is affirmative, step S106 switches the purge control valve 18 (VSV2) OFF and the process ends. Therefore, only when the duty cycle is equal to 100, the purge control valves 17 and 18 are switched ON and OFF at the same time. When the duty cycle exceeds 100, the purge control valve 18 is switched 0N immediately after the purge control valve 17 is switched OFF.

If the answer to step S98 is negative, step S108 detects whether or not the value of the duty cycle is equal to 100. If the value of the duty cycle is equal to 100 in step S108, the process ends without performing the valve switching operations. If the answer to step S108 is negative, step S110 detects whether or not the timer count T is equal to the value of (PGDUTY×2). If the answer to step S110 is affirmative (T=PGDUTY×2), the above step S106 is performed to switch the purge control valve 18 (VSV2) OFF and the process ends. If the answer to step S110 is negative, the process ends without performing the valve switching operations.

Figure 11:
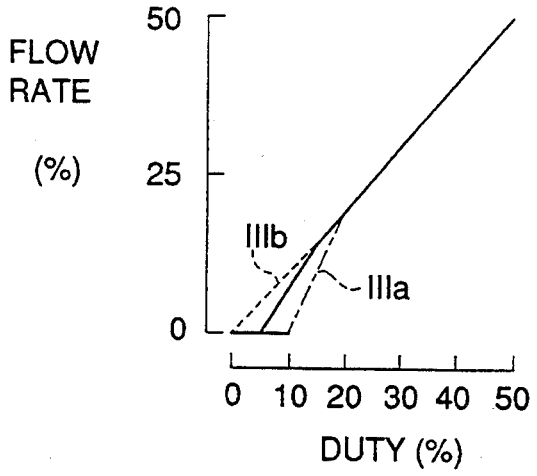
FIG. 11 is a chart for explaining the characteristic relationship between the duty ratio and the flow rate when the purge control process shown in FIG. 9 is performed.
Figure 12:
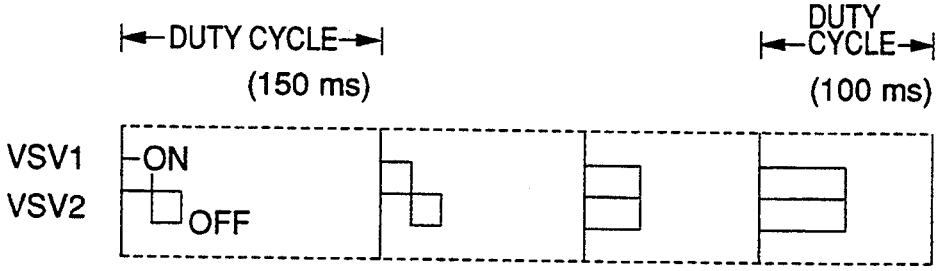
FIG. 12 is a timing chart showing the switching operations of the two purge control valves provided in the second embodiment.

By performing the purge control process shown in FIG. 9 and the valve switching process shown in FIG. 10, the switching operations of the purge control valve 17 (VSV1) and the purge control valve 18 (VSV2) are as shown in FIG. 12. When the duty cycle is equal to 100 ms, the flow rate in response to the duty ratio for each of the purge control valves 17 and 18 is indicated by a dotted chain line IIIa in FIG. 11, and the flow rate when the duty ratio is in the range between 0% and 20% becomes unstable. However, when the duty cycle is extended to 150 ms, the flow rate in response to the duty ratio is indicated by a solid line IIIb in FIG. 11. The flow rate when the duty ratio is in the range between 0% and 15% becomes unstable, but a range of the duty ratio in which the flow rate can stably change when the duty cycle is equal to 150 ms becomes wider than that of the 100−ms duty cycle case mentioned above.

In the second embodiment described above, when the calculated driving duty ratio PGDUTYa is smaller than 14. The duty cycle is set to 150 ms. When the calculated driving duty ratio PGDUTYa is greater than 14 and smaller than 20, the driving duty ratio PGDUTY is set to 20 ms. As shown in FIG. 12, the duty cycle is varied between 100 ms and 150 ms depending on the calculated driving duty ratio PGDUTYa. As described above, when the duty cycle is greater than 100 ms, the purge control valves 17 and 18 are alternately switched ON for a relatively short time period of 20 ms. It is thus possible to prevent the increase of the pulsating flow of evaporated fuel being fed by the purge control valves 17 and 18 into the intake passage. Also, it is unlikely that the evaporated fuel from the canister is fed into a specific cylinder of the engine by the two valves 17 and 18 arranged in parallel in the vapor passage 16.

Figure 13:
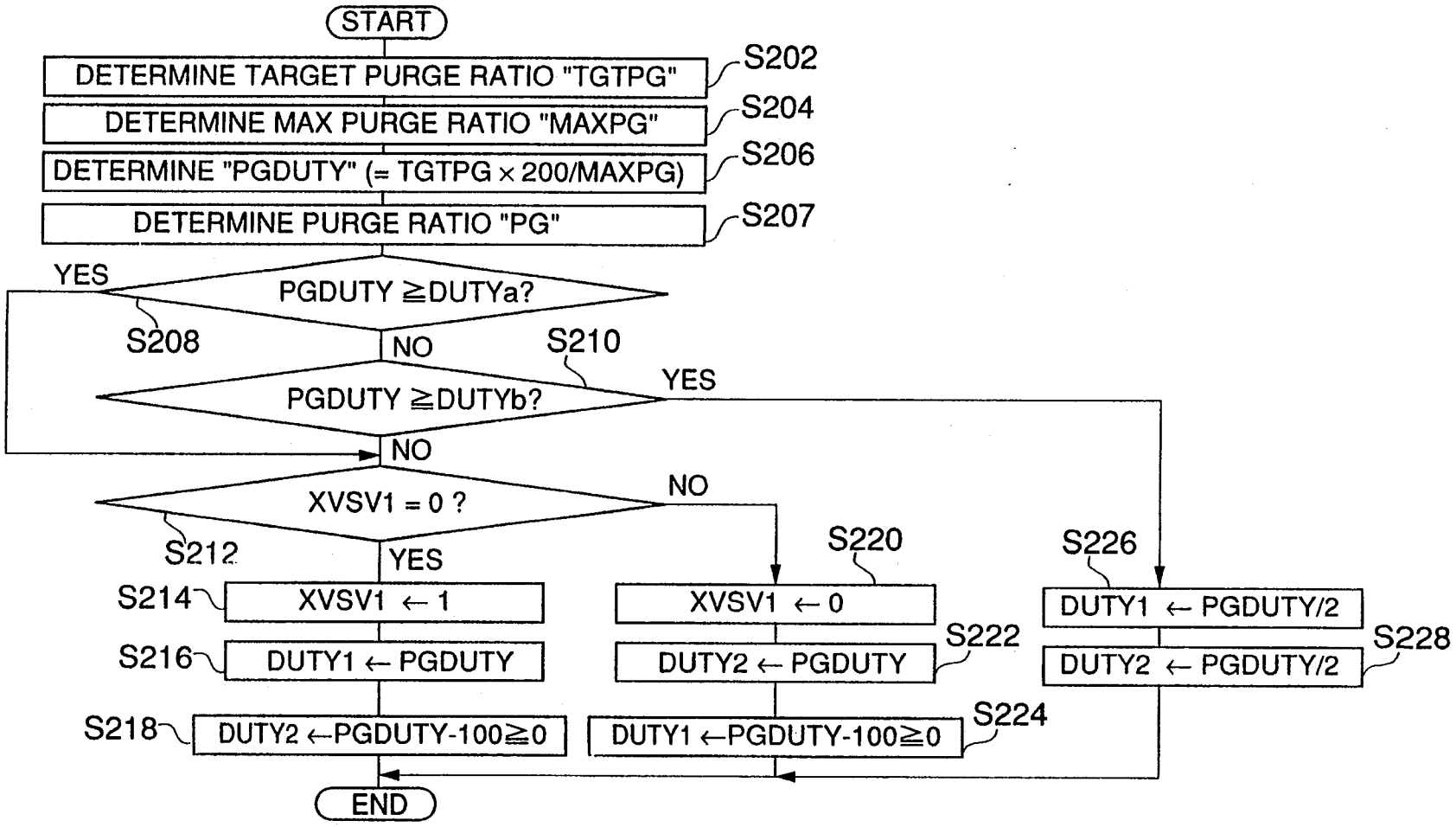
FIG. 13 is a flowchart for explaining a purge control process provided in a third embodiment of the present invention.

Next, a description will be given of a purge control process and a valve switching process provided in a third embodiment of the present invention. FIG. 13 shows the purge control process provided in the third embodiment. This process is repeatedly performed by the ECU 20 for each duty cycle of 100 ms.

In the purge control process shown in FIG. 13, steps S202, S204, S206 and S207 are, respectively, the same as the above steps S2, S4, S6 and S18 of the first embodiment shown in FIG. 3, and a description thereof will be omitted. After step S207 is performed, step S208 detects whether or not the value of the driving duty ratio PGDUTY is greater than a prescribed first value DUTYa. The first value DUTYa is equal to 120, for example. Step S210 detects whether or not the value of the driving duty ratio PGDUTY is greater than a prescribed second value DUTYb. The second value DUTYb is equal to 80, for example. If the answer to step S208 is affirmative (PGDUTY≧DUTYa) or the answer to step S210 is negative (PGDUTY<DUTYb), step S212 is performed. If the answer to step S208 is negative and the answer to step S210 is affirmative (DUTYb≦PGDUTY<DUTYa), steps S226 and 228 are performed to set the value of (PGDUTY/2) to each of the first and second duty ratios DUTY1 and DUTY2.

Step S212 detects whether or not a flag XVSV1 is equal to 0. This flag XVSV1 is set to 1 when it is required for the purge control valve 17 to be switched ON, and when it is required for the purge control valve 18 to be switched ON the flag XVSV1 is set to 0.

If the answer to step S212 is affirmative (XVSV1=0), step S214 sets the flag XVSV1 to 1. Step S216 sets the value of the driving duty ratio PGDUTY to the first duty ratio DUTY1 provided for the purge control valve 17. Step S218 sets the value of (PGDUTY−100) to the second duty ratio DUTY2 provided for the purge control valve 18 only when the value of (PGDUTY−100) is greater than zero. If the value of (PGDUTY−100) is equal to or smaller than zero, step S218 sets zero "0" to the second duty ratio DUTY2. Then, the purge control process ends.

If the answer to step S212 is negative (XVSV1=1), step S220 sets the flag XVSV1 to 0. Step S222 sets the value of the driving duty ratio PGDUTY to the second duty ratio DUTY2 provided for the purge control valve 18. Step S224 sets the value of (PGDUTY−100) to the first duty ratio DUTY1 only when the value of (PGDUTY−100) is greater than zero. If the value of (PGDUTY−100) is equal to or smaller than zero, step S224 sets zero "0" to the first duty ratio DUTY1. Then, the purge control process ends.

Generally, it is likely that the purge control valves 17 and 18 are not adequately opened when the duty ratio is below 20%, and that the purge control valves 17 and 18 are not adequately closed when the duty ratio is above 80%. Therefore, the change in the flow rate becomes unstable or non-linear when the duty ratio is in the ranges between 0% and 20% and between 80% and 100%. In the purge control process provided in the third embodiment, the change in the flow rate is made stable by performing the switching operations of the valves 17 and 18 preferentially when the duty ratio is in the range between 20% and 80%.

Figure 14:
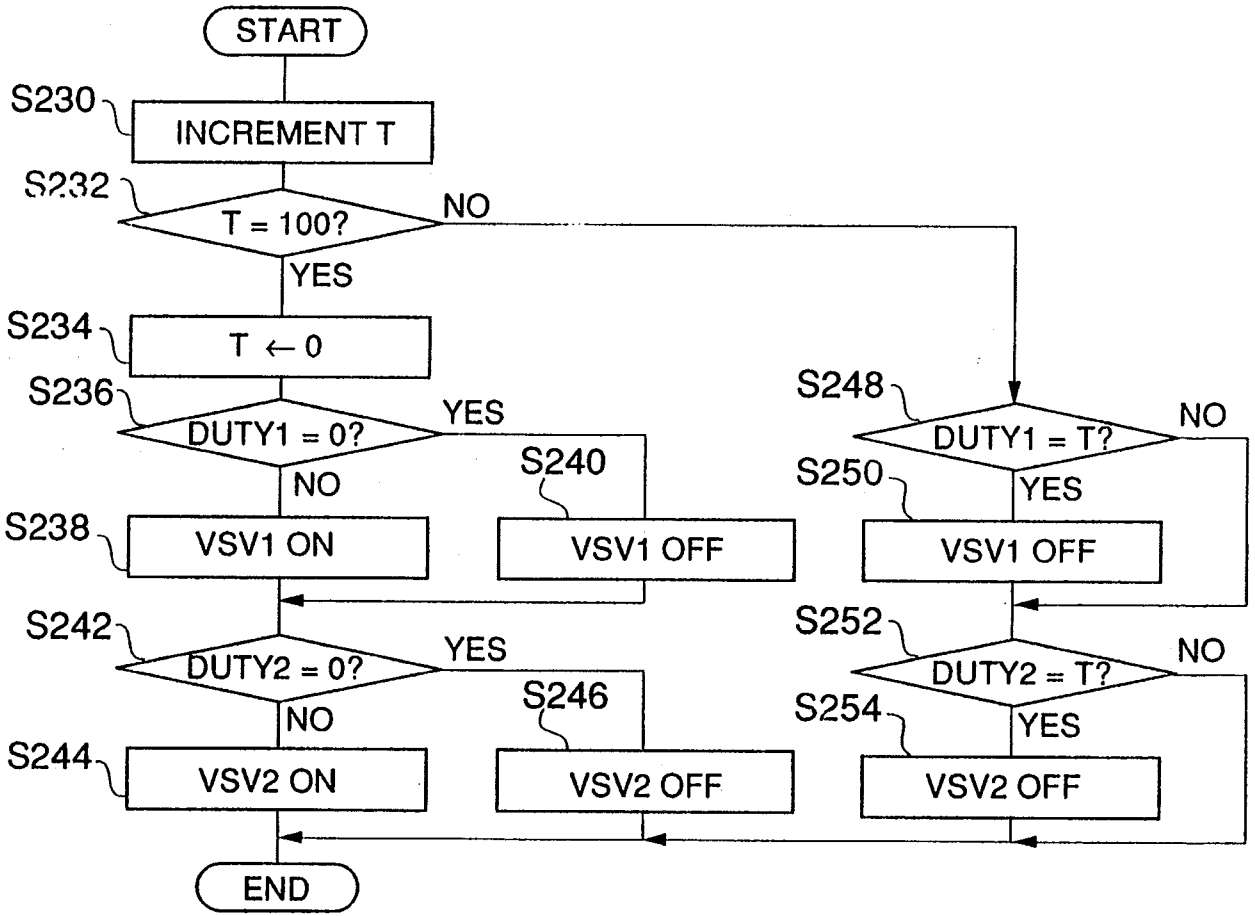
FIG. 14 is a flowchart for explaining a valve switching process provided in the third embodiment of the present invention.

FIG. 14 shows the valve switching process provided in the third embodiment. This process is repeatedly performed by the ECU 20 per 1 ms. In the valve switching process shown in FIG. 14, step S230 increments a timer count T. Step S232 detects whether or not the value of the timer count T is equal to 100. If the answer to step S232 is affirmative (T=100), step S234 resets the timer count T to zero. If the answer to step S232 is negative, step S248 (which will be described later) is performed.

After step S234 is performed, step S236 detects whether or not the value of the first duty ratio DUTY1 provided for the purge control valve 17 (VSV1) is equal to 0. If DUTY1=0, step S240 switches the purge control valve 17 (VSV1) OFF. If the value of the first duty ratio DUTY1 is not equal to 0, step S238 switches the purge control valve 17 (VSV1) ON.

Step S242 detects whether or not the value of the second duty ratio DUTY2 provided for the purge control valve 18 (VSV2) is equal to 0. If DUTY2=0, step S246 switches the purge control valve 18 (VSV2) OFF. If the value of the second duty ratio DUTY2 is not equal to 0, step S244 switches the purge control valve 18 (VSV2) ON. Then, the valve switching process ends.

If the value of the timer count (T) is not equal to 100 in step S232, step S248 detects whether or not the value of the first duty ratio DUTY1 is equal to the value of the timer count T. If DUTY1=T, step S250 switches the purge control valve 17 (VSV1) OFF. If the value of the first duty ratio DUTY1 is not equal to the value of the timer count T, step S252 is performed. In this step S252, it is detected whether or not the value of the second duty ratio DUTY2 is equal to the value of the timer count T. If DUTY2=T, step S254 switches the purge control valve 18 (VSV2) OFF. Then, the valve switching process ends.

Figure 15:
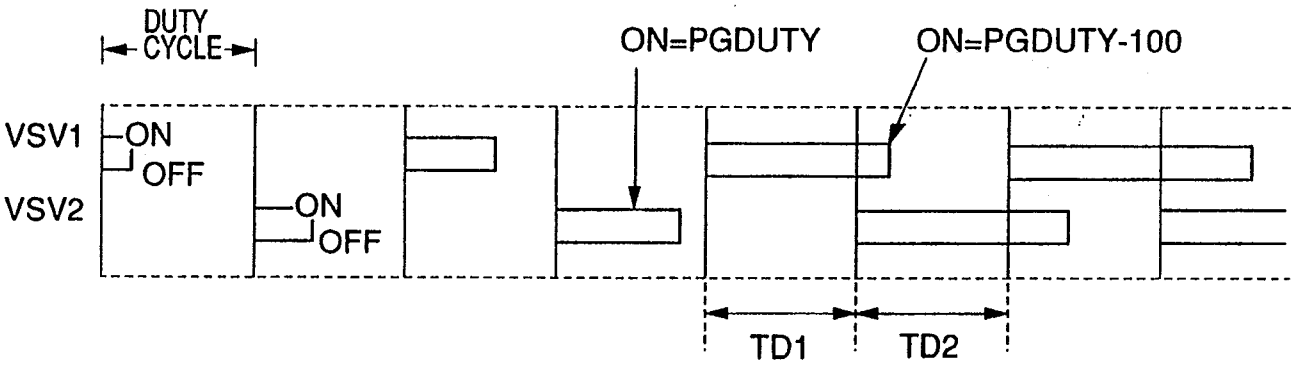
FIG. 15 is a timing chart showing the switching operations of the two purge control valves provided in the third embodiment.

By performing the purge control process shown in FIG. 13 and the valve switching process shown in FIG. 14, the switching operations of the purge control valve 17 (VSV1) and the purge control valve 18 (VSV2) are as shown in FIG. 15.

When the driving duty ratio PGDUTY is smaller than 80, the purge control valves 17 and 18 are alternately switched ON and OFF for every two duty cycles, and they are not switched at the same time, as shown in FIG. 15.

When the driving duty ratio PGDUTY is greater than 100, the purge control valve 17 (VSV1) is switched ON throughout a duty cycle TD1 and the valve 17 is continuously ON during the time period of (PGDUTY−100) in another duty cycle TD2 after the duty cycle TD1. If the timer count T reaches the value of (PGDUTY−100), the purge control valve 17 is switched OFF. Also, the purge control valve 18 (VSV2) is switched ON and OFF in a manner similar to that of the purge control valve 17 (VSV1), as shown in FIG. 15.

In the third embodiment described above, the purge control valves 17 and 18 are alternately switched ON and OFF for every two duty cycles, and both are not switched ON at the same time. It is thus possible to prevent the increase of the pulsating flow of evaporated fuel fed by the purge control valves 17 and 18 into the intake passage. Also, it is unlikely that the evaporated fuel from the canister 11 is fed into a specific cylinder of the engine by the purge control valves 17 and 18 arranged in parallel in the vapor passage 16, thus preventing the turbulence of the air-fuel ratio from occurring. Also, the number of switching operations of the purge control valve 17 of the third embodiment is reduced to nearly half that of the first embodiment. Thus, the noises due to the switching operations of the purge control valves 17 and 18 of the third embodiment are reduced, and the durability is increased.

Figure 16:
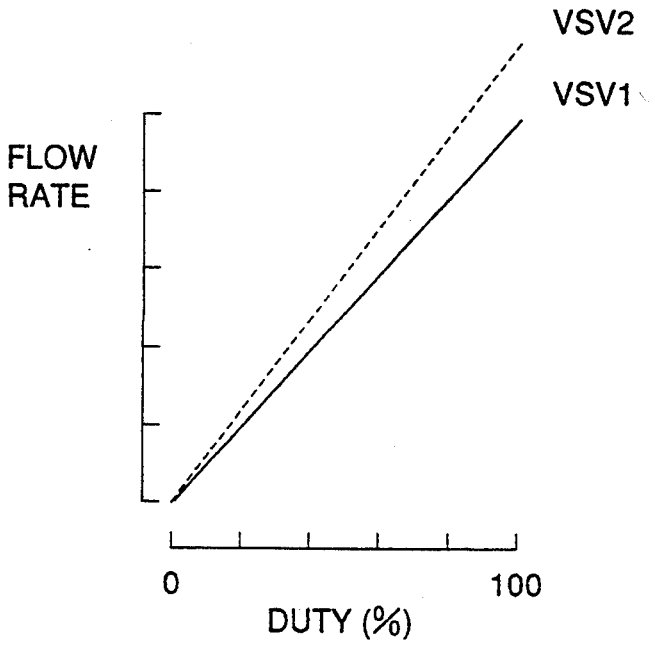
FIG. 16 is a chart for explaining the characteristic relationship between the duty ratio and the flow rate for each of the two purge control valves.

FIG. 16 shows the characteristic relationship between the duty ratio and the flow rate for each of the purge control valves 17 and 18, provided in the third embodiment. A solid line in FIG. 16 indicates the characteristic relationship for the purge control valve 17 (VSV1), and a dotted line in FIG. 16 indicates the characteristic relationship for the purge control valve 18 (VSV2). Even when there is a difference between the two characteristic relationships, the difference can be eliminated because the two purge control valves are alternately switched on and off for every two duty cycles.

Figure 17:
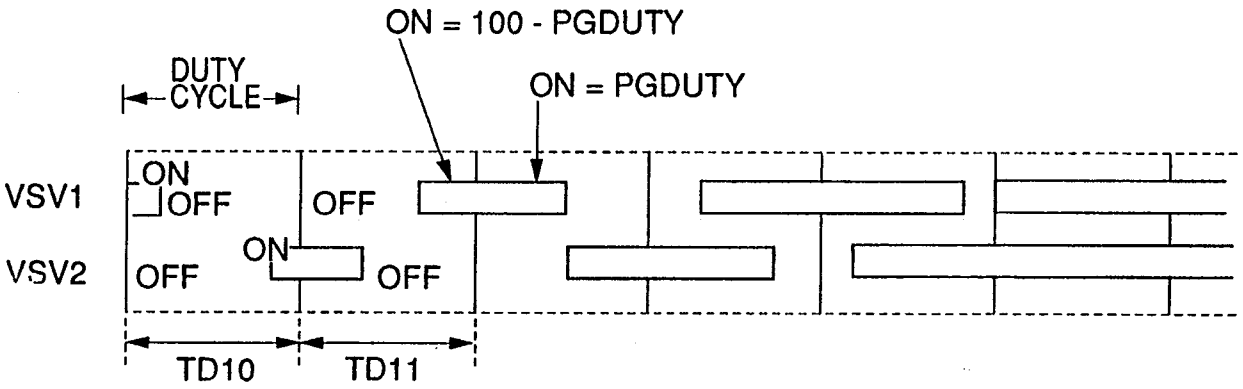
FIG. 17 is a timing chart showing the switching operations of the two purge control valves provided in a modification of the third embodiment.

FIG. 17 shows the switching operations of the two purge control valves 17 and 18 provided in a modification of the third embodiment. In the switching operations shown in FIG. 17, if the flag XVSV1 is equal to 1 and the driving duty ratio PGDUTY is equal to 20 at a duty cycle TD10, the purge control valve 17 (VSV1) is switched ON during a time period from the timer count T=0 to T=20. The purge control valve 18 (VSV2) is switched ON during a time period from T=80 to T=100 at the duty cycle TD10. If the flag XVSV1 is equal to 0 and the PGDUTY is equal to 30 at a duty cycle TD11, the valve 18 (VSV2) is continuously ON during a time period from T=0 to T=30. The valve 17 (VSV1) is switched ON during a time period from T=70 to T=100 at the duty cycle TD11. In the switching operations mentioned above, the two purge control valves are alternately switched ON and OFF for every two duty cycles, and both are not switched ON and OFF at the same time. Thus, the increase of the pulsating flow of evaporated fuel being fed into the intake passage can be prevented. Also, the number of switching operations of the purge control valve 17 is decreased to nearly half that of the first embodiment. Thus, the noise due to the switching operations of the purge control valves 17 and 18 can be reduced, and the durability of the devices can be increased.

Figure 2:
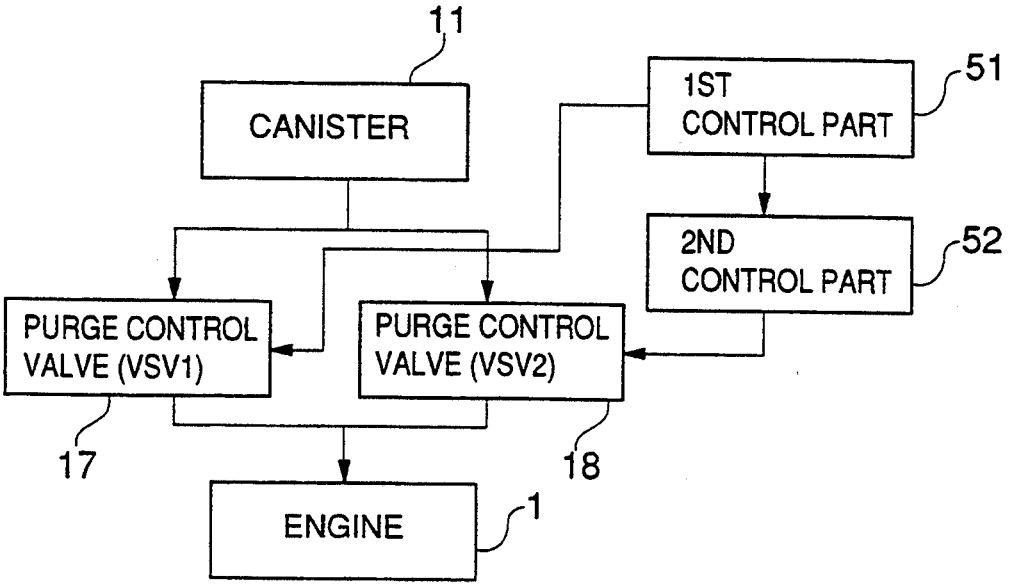
FIG. 2 is a block diagram showing a first embodiment of an evaporated fuel purge control apparatus according to the present invention.

Next, a description will be given of the first embodiment of the evaporated fuel purge control apparatus according to the present invention. FIG. 2 shows this evaporated fuel purge control apparatus. In the apparatus shown in FIG. 2, a plurality of purge control valves are arranged in parallel in a purge passage between the canister 11 and the intake passage leading to the engine 1, the purge control valves including at least the purge control valve 17 (VSV1) switched on and off based on a control factor the control factor includes a driving duty ratio value indicating an on-time within a duty cycle of a total duty-cycle time for the valve 17, and the purge control valve 18 (VSV2) switched on and off based on a control factor indicating an on-state or off-state of the valve 18 for a total duty-cycle time.

The evaporated fuel purge control apparatus shown in FIG. 2 also includes a first control part 51 for setting a first control factor for the valve 17 so that the valve 17 is switched on and off at a duty cycle indicated by the first control factor, and a second control part 52 for setting a second control factor for the valve 18 so that the valve 18 is switched on and off at a timing different from a timing of the valve 17 being switched on and off.

Next, a description will be given of a fourth embodiment of the evaporated fuel purge control apparatus according to the present invention, with reference to FIGS. 18 through 26.

In the apparatus provided in the first embodiment described above, it is difficult to obtain an accurate flow rate of evaporated fuel in accordance with a control ratio indicated by a signal from the ECU 20 when the two purge control valves have significant production errors or secular changes. If a signal indicating the correct control ratio is output by the ECU 20 to each of the valves, various amounts of the evaporated fuel may be fed into the intake passage due to the production errors or the secular changes of the valves.

Japanese Laid-Open Patent Publication No.60-252901 discloses a system provided with a transducer for converting the control ratio of an input signal into a derived control ratio such that the resulting flow rate is proportional to the derived control ratio supplied from the transducer. However, in the apparatus of the first embodiment, it is impossible to obtain the control ratios supplied to the two valves when the valves have various production errors and secular changes. If the system of this publication is applied to the apparatus of the first embodiment, it is impossible to correct the derived duty ratio supplied from the transducer when the engine is operating. Thus, when the valves have various production errors or secular changes, various amounts of evaporated fuel may be fed into the intake passage of the engine. The turbulence of the air fuel ratio may occur, and the exhaust emission and the driveability may become worse.

Figure 18:
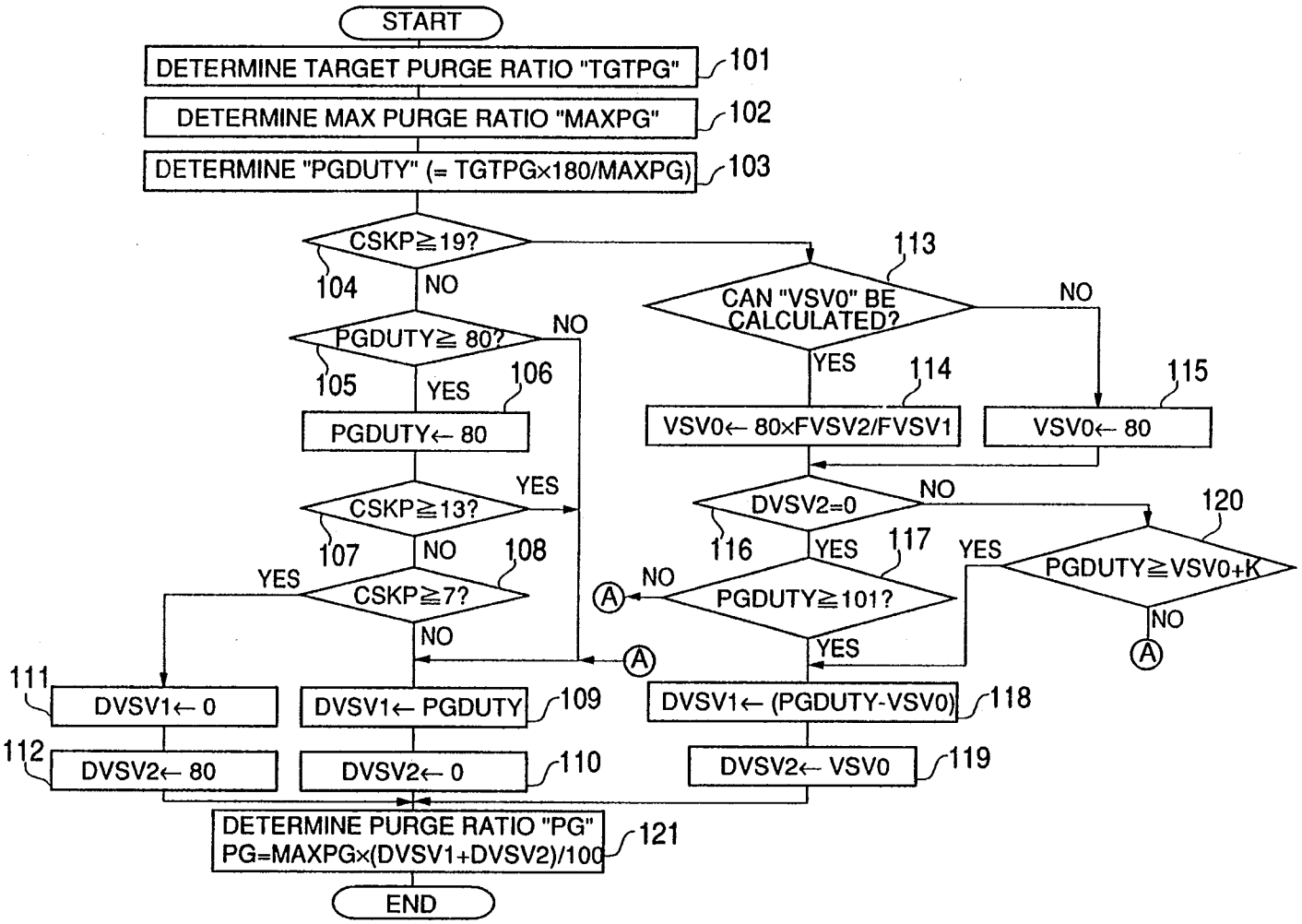
FIG. 18 is a flowchart for explaining a purge control process provided in a fourth embodiment of the present invention.

In the purge control process provided in the fourth embodiment as shown in FIG. 18, the above mentioned difficulty can be eliminated by suitably adjusting, when the two purge control valves are switched on at the same time, a control factor set for a first purge control valve based on the ratio of a flow rate factor determined by a determining part when a second purge control valve is opened to a flow rate factor determined by the determining part when the first purge control valve is opened.

In the fourth embodiment described below, the purge control valve 17 is indicated as the first purge control valve (VSV1) which is switched on and off based on a control factor, the control factor includes a driving duty ratio value indicating an on-time within a duty cycle of a total duty-cycle time for the first purge control valve, and the purge control valve 18 is indicated as the second purge control valve (VSV2) which is switched on and off based on a control factor indicating an on-state or off-state of the second purge control valve for a total duty-cycle time.

In the fourth embodiment described below, it is assumed that a flow rate of evaporated fuel when the first purge control valve VSV1 is opened (the duty ratio: 100%) is equal to 100 and a flow rate of evaporated fuel when the second purge control valve VSV2 is opened is equal to 80.

FIG. 18 shows a purge control process provided in the fourth embodiment. This process is repeatedly performed by the ECU 20 per 100 ms, which corresponds to a duty cycle at which the switching operation of the first purge control valve VSV1 is controlled.

In the purge control process shown in FIG. 18, step 101 determines a target purge ratio TGTPG by adding a prescribed purge changing ratio A to a previous purge ratio PG previously determined in this process (TGTPG=PG+A).

Step 102 determines a maximum purge ratio MAXPG in accordance with the engine speed NE and the intake air amount Q/N per revolution of the engine crankshaft. This maximum purge ratio (MAXPG) is determined by retrieving a map stored in the ROM 22. The map stored in the ROM 22 is, for example, a map shown in FIG. 19 in which the maximum purge ratios are predefined in accordance with the intake air amount Q/N and the engine speed NE. The engine speed NE is indicated by a signal supplied from the crank angle sensor 33 and the intake air amount Q/N is indicated by a signal supplied from the air flow meter 7. The ECU 20 retrieves the map stored in the ROM 22 using these signals to determine the value of the maximum purge ratio MAXPG therefrom. The value of the MAXPG corresponds to the maximum flow rate of evaporated fuel being fed into the intake passage.

Step 103 determines a driving duty ratio PGDUTY with respect to the first purge control valve VSV1 from the target purge ratio TGTPG and the maximum purge ratio MAXPG in accordance with the following equation.

$$PGDUTY = TGTPG \times 180/MAXPG \quad (5)$$

It is apparent from the equation (5) that the maximum value of the driving duty ratio PGDUTY is equal to 180 (%). The PGDUTY varies as a linear function of the TGTPG if the MAXPG is constant. The driving duty ratio PGDUTY is at the maximum (=180%) when the value of the TGTPG is equal to the value of the MAXPG.

Step 104 detects whether or not the value of a skip counter CSKP is equal to or greater than 19. If CSKP<19, step 105 is performed. If CSKP≧19, step 113 is performed. Initially, the skip counter CSKP is reset to zero. The skip counter CSKP is incremented in a separate air-fuel ratio feedback control process (which will be described below) each time a correction factor FAFA (also described below) is determined or updated.

The skip counter CSKP at the first time is equal to 0, and the answer to step 104 is negative. Thus, initially, step 105 is performed after step 104 is performed. Step 105 detects whether or not the value of the driving duty ratio PGDUTY is equal to or greater than 80. The value of 80 corresponds to a duty cycle at which the switching operation of the second purge control valve VSV2 is controlled. If PGDUTY<80, step 109 is performed. If PGDUTY≧80, step 106 is performed.

Initially, the target purge ratio is nearly equal to zero and the driving duty ratio PGDUTY is smaller than 80. Thus, initially, step 109 is performed after step 105 is performed. Step 109 sets the value of the driving duty ratio PGDUTY to a control factor DVSV1 provided for the first purge control valve VSV1. Step 110 sets zero "0" to a control factor DVSV2 provided for the second purge control valve VSV2. After step 110 is performed, step 121 determines a purge ratio PG from the control factors DVSV1 and DVSV2 in accordance with the following equation.

$$PG = MAXPG \times (DVSV1 + DVSV2)/100 \quad (6)$$

After step 121 is performed, the purge control process ends.

Since the performing of this process is repeated, the driving duty ratio PGDUTY determined in step 103 is gradually increased to a value of 80 or greater. Then, the answer to step 105 is affirmative (PGDUTY≧80), step 106 is performed. Step 106 sets the value of 80 to the driving duty ratio PGDUTY. After step 106 is performed, step 107 detects whether or not the skip counter CSKP is equal to or greater than 13. Also, step 108 detects whether or not the skip counter CSKP is equal to or greater than 7.

If both the answers to steps 106 and 107 are negative (CSKP<7), or if the answer to step 106 is affirmative (13≦CSKP≦18), the above steps 109–110 and 121 are performed and the purge control process ends.

If the answer to step 106 is negative and the answer to step 107 is affirmative (7≦CSKP≦12), steps 111–112 and 121 are performed. Step 111 sets zero "0" to the control factor DVSV1, and step 112 sets the value of 80 to the control factor DVSV2. Also, in step 121, the value of the purge ratio PG is determined in accordance with the equation (6) from the control factors DVSV1 and DVSV2. After step 121 is performed, the purge control process ends.

In a manner described above, if PGDUTY≧80, the target purge ratio TGTPG is maintained at a constant value during a prescribed timer period and the switching operations of the purge control valves VSV1 and VSV2 are performed in accordance with the changing value of the skip counter CSKP as follows: 1) the valve VSV1 is switched ON at the DVSV1 of 80 while the valve VSV2 is OFF; 2) the valve VSV2 is switched ON at the DVSV2 of 80 while the valve VSV1 is OFF; and 3) the valve VSV1 is switched ON at the DVSV1 of 80 while the valve VSV2 is OFF.

Figure 23A:
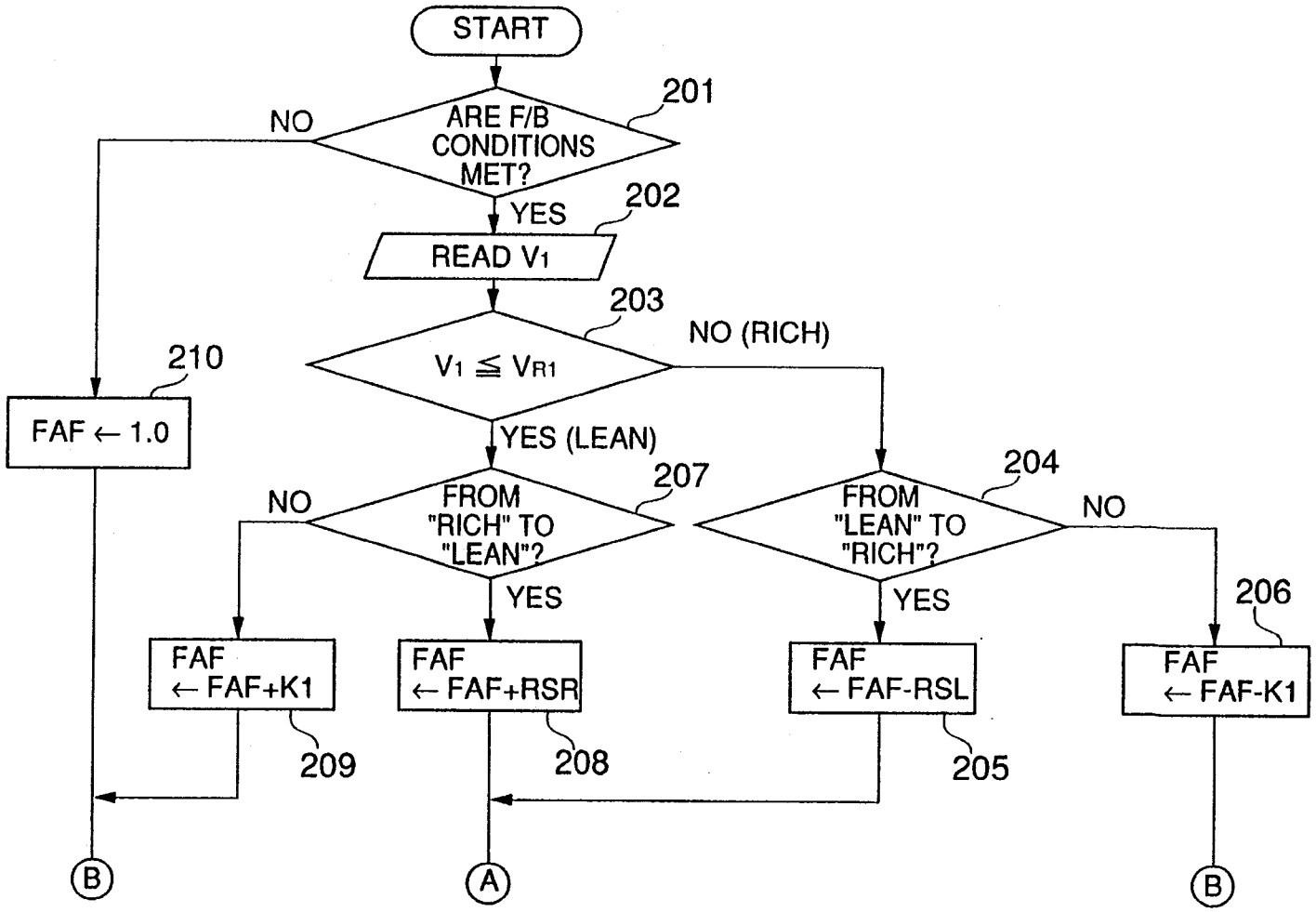
FIGS. 23A and 23B are flowcharts for explaining an air-fuel ratio feedback control process in which FAF correction values used in the purge control process shown in FIG. 18 are determined.
Figure 23B:
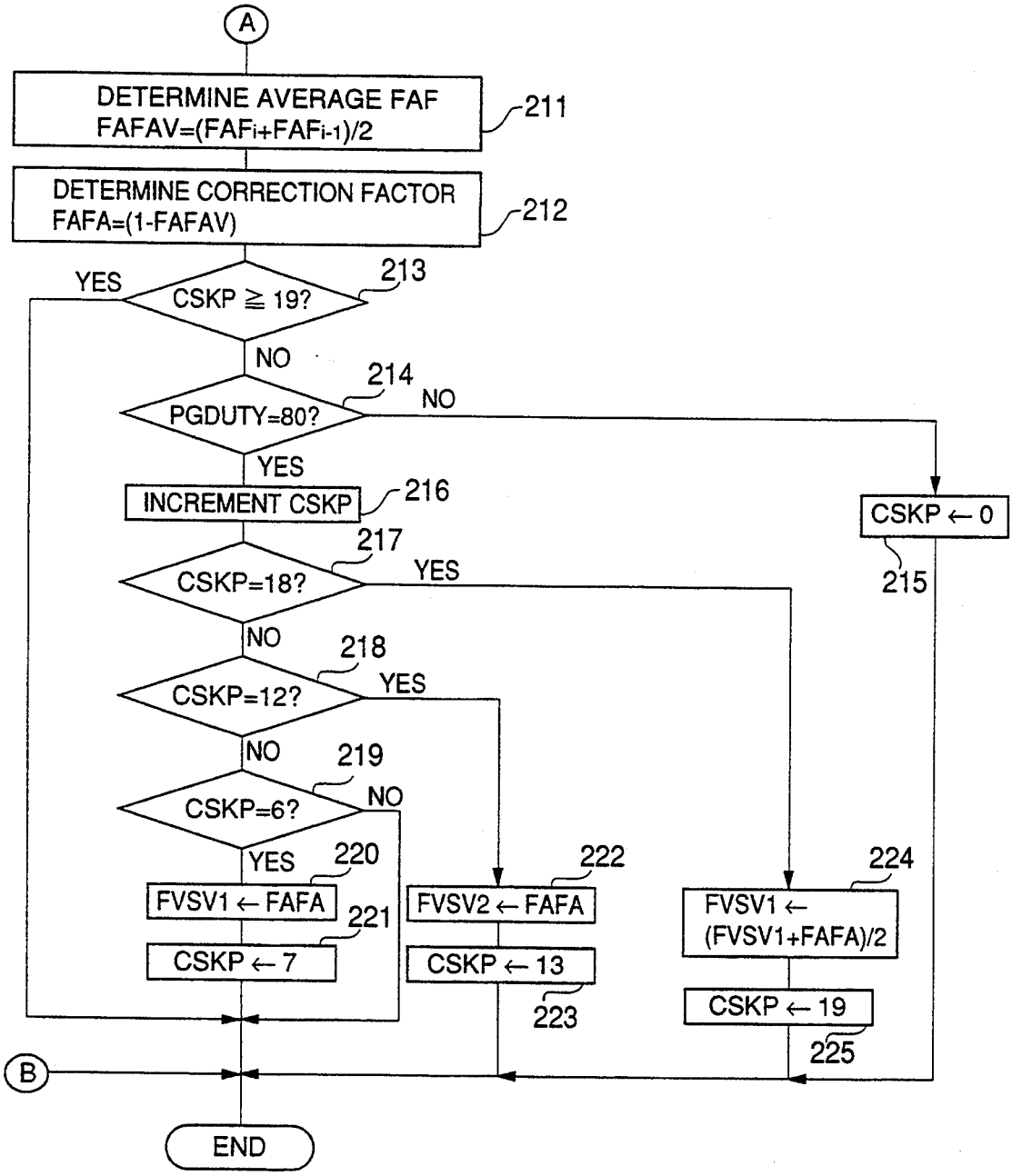

When the performing of the process is repeated and the skip counter CSKP is equal to or greater than 19 (CSKP≧19), the answer to step 104 is affirmative, and then step 113 is performed. Step 113 detects whether or not a correction value VSV0 can be accurately calculated based on FAF correction values FVSV1 and FVSV2. The FAF correction values FVSV1 and FVSV2 are determined in the separate air-fuel ratio feedback control process which is shown in FIGS. 23A and 23B. The FAF correction value FVSV1 is provided for the first purge control valve VSV1, and the FAF correction value FVSV2 is provided for the second purge control valve VSV2.

When the FAF correction values FVSV1 and FVSV2 are relatively small, the air-fuel mixture of the engine is so lean that the change in a feedback factor FAF (which will be described below) is not sensitive to accurately calculate the correction value VSV0. At this time, it is detected in step 113 that the correction value VSV0 cannot be accurately calculated. If the answer to step 113 is negative, step 115 is performed to set the value of 80 to the correction value VSV0 so as to avoid erroneous correction of the control factors DVSV1 and DVSV2.

If the answer to step 113 is affirmative, step 114 is performed. Step 114 determines the correction value VSV0 from the FAF correction values FVSV1 and FVSV2 in accordance with the following equation.

$$VSV0 = 80 \times FVSV2/FVSV1 \quad (7)$$

In the above equation (7), the FAF correction values FVSV1 and FVSV2 are determined in the air-fuel ratio feedback control process, and they are representative of the flow rate of the evaporated fuel being fed into the intake passage through one of the first and second purge control valves VSV1 and VSV2. The correction value VSV0 according to the equation (7) indicates a deviation of the feedback factor FAF from the average value of 1.0 when one of the valves VSV1 and VSV2 is solely switched ON in alternate order by the same control factor of 80.

When the valves VSV1 and VSV2 have no production errors or secular changes, the FAF correction values FVSV1 and FVSV2 are equal to each other. The correction value VSV0 is set to 80 according to the equation (7) in step 114.

However, when the valves VSV1 and VSV2 have significant production errors or secular changes, the FAF correction values FVSV1 and FVSV2 are different from each other. The correction value VSV0 is determined in step 114, and it indicates the ratio of the flow rate when the valve VSV2 is solely switched ON by the control factor DVSV2 of 80 to the flow rate when the valve VSV1 is solely switched ON by the control factor DVSV1 of 80.

After step 114 or step 115 is performed, step 116 is performed. Step 116 detects whether or not the value of the control factor DVSV2 is equal to zero. In this step, it is detected whether the valve VSV2 is closed or not. If the answer to step 116 is affirmative (DVSV2=0), step 117 is performed. Step 117 detects whether or not the driving duty ratio PGDUTY is equal to or greater than 101.

If the answer to step 117 is affirmative (PGDUTY≧101), steps 118–119 and 121 are performed. Step 118 sets the value of (PGDUTY−VSV2) to the control factor DVSV1 provided for the first purge control valve VSV1. The control factor DVSV1 at this time is equal to the value of the driving duty ratio PGDUTY from which the correction value VSV0 (being set in step 114 or 115 and approximately equal to 80) is subtracted. Step 119 sets the correction value VSV0 to the control factor DVSV2 provided for the second purge control valve VSV2. Thus, when the driving duty ratio PGDUTY is equal to or greater than 101, the valve VSV2 is switched ON by the control factor DVSV2 (equal to VSV2) to obtain a flow rate corresponding to the maximum duty ratio (equal to 80) by the valve VSV2, and the valve VSV1 is switched ON by the control factor DVSV1 (equal to (PGDUTY−VSV2)) to obtain the remaining flow rate (the remainder of the necessary flow rate) by the valve VSV1.

If the answer to step 117 is negative (PGDUTY<101), the above steps 109–110 and 121 are performed. The value of the driving duty ratio PGDUTY is set to the control factor DVSV1 for the valve VSV1, and the control factor DVSV2 for the valve VSV2 is set to zero. Thus, when the driving duty ratio is smaller than 101, the valve VSV1 is switched ON by the control factor DVSV1 (equal to the driving duty ratio PGDUTY) to obtain all the necessary flow rate by the valve VSV1, and the valve VSV2 is switched OFF by the control factor DVSV2 (equal to zero).

Figures 19, 20:
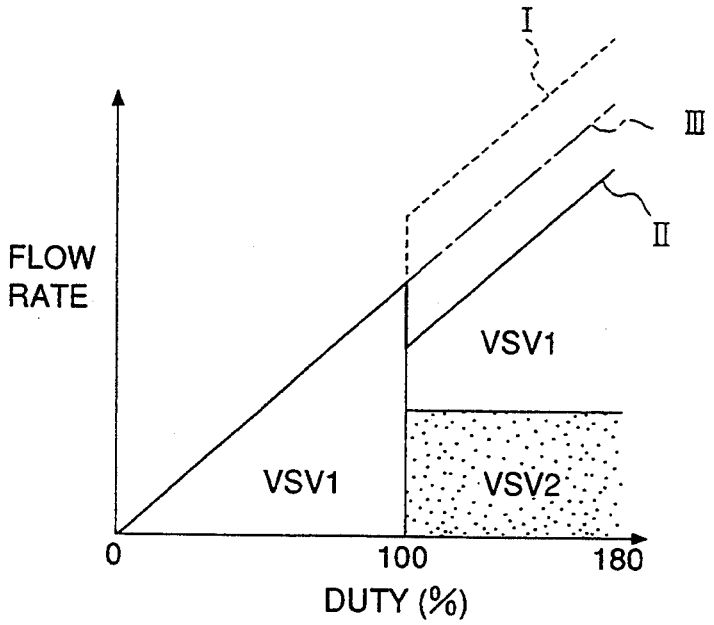
FIG. 19 is a chart showing a map in which the maximum purge ratios are pre-defined in accordance with the intake air amount and the engine speed.
FIG. 20 is a chart for explaining the characteristic relationship between the duty ratio and the flow rate when the purge control process shown in FIG. 18 is performed.

FIG. 20 shows the characteristic relationship between the flow rate and the duty ratio when the purge control process shown in FIG. 18 is performed. As shown in FIG. 20, when the calculated duty ratio is below 100%, only the first purge control valve VSV1 is opened to obtain the necessary flow rate. When the calculated duty ratio is above 100%, the second purge control valve VSV2 is fully opened so as to obtain the maximum flow rate by the valve VSV2, and the first purge control valve VSV1 is also opened so as to obtain the remaining flow rate by the valve VSV1. If the actual flow rate at the valve VSV2 is greater than the intended flow rate (the maximum flow rate) due to the production errors or secular changes, an excessively large amount of evaporated fuel is fed into the intake passage, and the resulting flow rate deviates from the necessary level as indicated by a dotted line I in FIG. 20. If the actual flow rate at the valve VSV2 is smaller than the intended flow rate due to the production errors or secular changes, an excessively small amount of evaporated fuel is fed into the intake passage, and the resulting flow rate deviates from the necessary level as indicated by a solid line II in FIG. 20.

Next, a description will now be given of a case in which the amount of evaporated fuel fed into the intake passage is lacking due to the production errors or the like of the valves, as indicated by the solid line II in FIG. 20. The change in the feedback factor FAF determined in the air-fuel ratio feedback control process greatly fluctuates as shown in FIG. 21A immediately after the switching operations of the valves VSV1 and VSV2 change at a time point "ta" (from a mode of only the VSV1 ON to a mode of both the valves VSV1 and VSV2 ON) as shown in FIG. 21B. Thus, the turbulence of the air-fuel ratio may occur at this time in the engine. FIG. 21C shows the change in the target purge ratio when the purge control process is performed.

In the purge control process provided in the fourth embodiment, the control factors DVSV1 and DVSV2 are set to appropriate values such that the necessary flow rate can be stably obtained by means of performing the above steps 116–119 even if the two purge control valves have significant production errors or secular changes. As mentioned above, when the driving duty ratio PGDUTY is increased to a value greater than 101, the control factor DVSV2 is set to the correction value VSV0 (derived from the ratio of the FVSV2 to the FVSV1) so as to obtain a flow rate corresponding to the maximum duty ratio of 80% by the valve VSV2, and the control factor DVSV1 is set to the value of (PGDUTY−VSV2) so as to obtain the remaining flow rate (the remainder of the necessary flow rate) by the valve VSV1. Therefore, in the purge control process provided in the fourth embodiment of the present invention, when PGDUTY≧101, it is possible that the change in the flow rate is made smooth around the duty ratio of 100% and that the resulting flow rate is in accordance with the necessary level as indicated by a dotted chain line III in FIG. 20.

In the meantime, if the answer to step 116 of the purge control process shown in FIG. 18 is negative (DVSV2 not equal to 0), step 120 is performed. Step 120 detects whether or not the value of the driving duty ratio PGDUTY is equal to or greater than the value of (VSV2+K), where "K" denotes a value of the minimum duty ratio for the valve VSV1 to obtain the minimum flow rate by the valve VSV1. If PGDUTY≧(VSV2+K), the above steps 118–119 are performed. If PGDUTY<(VSV2+K), the above steps 109–110 are performed.

The step 120 mentioned above is performed to ensure the control factors DVSV1 and DVSV2 having a hysteretic continuity around the duty ratio of 100%. FIG. 22 shows the relationship between the valve switching operations and the duty ratio changes. The characteristic relationship between the duty ratio and the flow rate is indicated by a solid line IV in FIG. 22. As indicated by a point "a" in FIG. 22, the valve VSV2 is fully opened by the control factor DVSV2 and the valve VSV1 is also opened by the control factor DVSV1 (through the steps 117–119) when the calculated driving duty ratio PGDUTY is greater than 100. As indicated by a point "b" in FIG. 22, only the valve VSV2 is fully closed by the control factor DVSV2 (through the steps 120 and 109–110) when the driving duty ratio PGDUTY is smaller than the value of (VSV2+K). Thus, it is possible that the number of switchings of the valve VSV2 is reduced, and that the durability of the valve VSV2 is increased.

Next, a description will be given of the air-fuel ratio feedback control process in which the FAF correction values FVSV1 and FVSV2 used in the above described purge control process are determined. FIGS. 23A and 23B show this air-fuel ratio feedback control process. The air-fuel ratio feedback control process shown in FIGS. 23A and 23B is repeatedly performed by the ECU 20 per 4 ms.

In the process shown in FIG. 23A, step 201 detects whether or not a set of prescribed air-fuel ratio feedback conditions are met. These feedback conditions are: (1) the engine cooling water temperature are higher than a given temperature; (2) the engine is not during a starting operation; (3) the amount of fuel supply after the starting operation is not increasing; (4) the amount of fuel supply is not increasing during an idling operation; (5) the engine is not during a fuel-cut operation; and so on. If any of these feedback conditions is not met, step 210 is performed to set the feedback factor FAF to the value of 1.0, and the feedback control process ends. If all the feedback conditions are met in step 201, step 202 is performed. Step 202 reads a voltage V1 indicated by a signal supplied from the oxygen sensor 31. This voltage V1 is produced by the A/D converter 32 from the signal from the oxygen sensor 31, and is supplied to the CPU 24 via the input interface circuit 25.

After step 202 is performed, step 203 detects whether or not the voltage V1 read in step 202 is equal to or lower than a reference voltage Vr1. This reference voltage Vr1 is predetermined so as to indicate the stoichiometric air-fuel ratio. If the answer to step 203 is negative (V1>Vr1), it is judged that the air-fuel mixture of the engine is rich (or, the air-fuel ratio is greater than 1.0). Then, step 204 detects whether or not the air-fuel mixture changes from the previous "lean" condition to the current "rich" condition.

If the answer to step 204 is affirmative, step 205 sets or updates the feedback factor FAF by subtracting a skip constant RSL from the previous feedback factor FAF (FAF←FAF−RSL). The previous feedback factor FAF is previously determined in the air-fuel ratio feedback control process and stored in the RAM 23. If the answer to step 204 is negative, step 206 sets the feedback factor FAF by subtracting an integral constant KI from the previous feedback factor FAF (FAF←FAF−KI), and the process ends.

In the meantime, if the answer to step 203 is affirmative (V1≦Vr1), it is judged that the air-fuel mixture of the engine is lean (or, the air-fuel ratio is smaller than 1.0). Then, step 207 detects whether or not the air-fuel mixture changes from the previous "rich" condition to the current "lean" condition.

If the answer to step 207 is affirmative, step 208 sets or updates the feedback factor FAF by adding a skip constant RSR to the previous feedback factor FAF (FAF←FAF+RSR). If the answer to step 207 is negative, step 209 sets the feedback factor FAF by adding the integral constant KI to the previous feedback factor FAF (FAF←FAF+KI), and then the process ends. The skip constants RSL and RSR mentioned above are predetermined as being adequate values greater than the integral constant KI.

The fuel injection valve 4 shown in FIG. 1 is controlled by the ECU 20 in accordance with a fuel injection time TAU so as to create a desired air-fuel ratio of the engine from the intake mixture. The fuel injection time TAU for which fuel is injected to the engine is determined for each of the engine cylinders at the ECU 20 by multiplying a basic fuel injection time by the above mentioned feedback factor FAF and other factors together. The basic fuel injection time is determined based on the engine speed and the intake air amount.

After step 205 or step 208 is performed so as to update the feedback factor FAF, a routine of the air-fuel ratio feedback control process according to the fourth embodiment of the present invention is performed. This routine is shown in FIG. 23B.

In the process shown in FIG. 23B, step 211 determines an average feedback factor FAFAV of the current feedback factor FAFi and the previous feedback factor FAFi−1 in accordance with the following equation.

$$FAFAV=(FAFi+FAFi-1)/2 \quad (8)$$

In the above equation (8), "FAFi" denotes the value of the feedback factor updated in step 205 or 208, and "FAFi−1" denotes the value of the previous feedback factor stored in the RAM 23. Next, step 212 determines a correction factor FAFA from the average feedback factor FAFAV in accordance with the following equation.

$$FAFA=1-FAFAV \quad (9)$$

This correction factor FAFA indicates a deviation of the feedback factor FAF from the average value of 1.0 when the air-fuel mixture of the engine is maintained at the stoichiometric level.

Generally, when the evaporated fuel from the canister 11 is fed into the surge tank 5 (or the intake passage) through the valves VSV1 and VSV2, the air-fuel ratio is increased to a value greater than 1.0 (the rich condition). In accordance with the change in the air-fuel ratio, the feedback factor FAF is updated to a value smaller than the previous value thereof through the process shown in FIG. 23A so that the air-fuel mixture of the engine is maintained at the stoichiometric level. Therefore, the correction factor FAFA determined according to the equation (9) is representative of the flow rate of the evaporated fuel being fed into the intake passage through the valves VSV1 and VSV2.

After step 212 is performed, step 213 detects whether or not the skip counter CSKP is equal to or greater than 19. If the answer to step 213 is affirmative (CSKP≧19), the process ends without performing other steps. However, initially, the skip counter CSKP is set to zero, and the answer to step 213 is negative. Then, step 214 is performed. Step 214 detects whether or not the value of the driving duty ratio PGDUTY (which is determined in step 103 in the purge control process shown in FIG. 18) is equal to 80. If the answer to step 214 is negative (PGDUTY not equal to 80), step 215 is performed to reset the skip counter CSKP to zero, and the process ends.

Since the performing of the purge control process is repeated, the driving duty ratio PGDUTY will be increased to the value of 80. If the answer to step 214 is affirmative (PGDUTY=80), step 216 is performed to increment the skip counter CSKP (CSKP←CSKP+1). After step 216 is performed, steps 217–219 are performed. Step 217 detects whether or not the skip counter CSKP is equal to 18. Step 218 detects whether or not the skip counter CSKP is equal to 12. Step 219 detects whether or not the skip counter CSKP is equal to 6. Initially, all the answers to the steps 217–219 are negative, and the process ends without performing other steps. In the previously described purge control process, when 1≦CSKP≦6, only the valve VSV1 is switched ON or opened by the driving duty ratio PGDUTY (which is approximately equal to the control value DVSV1 of 80) so as to feed the evaporated fuel into the intake passage at a flow rate corresponding to that when the duty ratio of the valve VSV1 is equal to 80%.

After the steps 211–214 and 216–219 are repeatedly performed, the skip counter CSKP is increased to the value of 6. Since the answer to the step 219 is affirmative, steps 220–221 are performed and then the process ends. Step 220 sets the FAF correction value FVSV1 to the value of the correction factor FAFA (FVSV1←FAFA). The FAF correction value FVSV1 (or the correction factor FAFA) at this time corresponds to the flow rate when the duty ratio of the valve VSV1 is equal to 80%. Step 221 sets the skip counter CSKP to the value of 7.

After the performing of the steps 211–214 and 216–219 is repeated further, the skip counter CSKP is increased to the value of 12. Since the answer to step 218 is affirmative, steps 222–223 are performed and then the process ends. Step 222 sets the FAF correction value FVSV2 to the value of the correction factor FAFA at this time (FVSV2←FAFA). In the previously described purge control process, when 7≦CSKP≦12, only the valve VSV2 is switched ON by the control value DVSV2 of 80 so as to feed the evaporated fuel into the intake passage at a flow rate corresponding to that when the duty ratio of the valve VSV2 is equal to 80%. Thus, the FAF correction value FVSV2 (or the correction factor FAFA) at this time corresponds to the flow rate when the duty ratio of the valve VSV2 is equal to 80% (the maximum). Step 223 sets the skip counter CSKP to the value of 13.

When the skip counter CSKP is increased to the value of 18, the answer to step 217 is affirmative. Steps 224–225 are performed and then the process ends. Step 224 sets the FAF correction value FVSV1 from the previous FAF correction value FVSV1 (previously determined in step 220) and the correction factor FAFA in accordance with the following equation.

$$FVSV1=(FVSV1+FAFA)/2 \quad (10)$$

In the previously described purge control process, when 13≦CSKP≦18, only the valve VSV1 is switched ON or opened by the driving duty ratio PGDUTY (which is approximately equal to the control value DVSV1 of 80). The correction factor FAFA in the above equation (10) corresponds to the flow rate when the duty ratio of the valve VSV1 is equal to 80%. Thus, the FAF correction value FVSV1 at this time is set to the average of the previous FAF correction value FVSV1 and the correction factor FAFA. Step 225 sets the skip counter CSKP to the value of 19.

Accordingly, in the previously described step 114 of the purge control process shown in FIG. 18, the FAF correction value FVSV2 in step 222 and the FAF correction value FVSV1 in step 224 are used to determine the correction value VSV0.

Alternately, in the above described step 212 of the process shown in FIG. 23B, the following equation can be used to determine the correction value FAFA.

$$FAFA=(1-FAFAV)/PG \quad (11)$$

In the above equation (11), "PG" denotes the value of the purge ratio determined in step 121 of the purge control process shown in FIG. 18. The correction factor FAFA thus determined by the equation (11) indicates a deviation of the feedback factor FAF from the average value of 1.0 (when the air-fuel mixture of the engine is maintained at the stoichiometric level), the above mentioned deviation being divided by the value of the purge ratio PG.

In the previously described case in which the correction value FAFA is determined by the equation (9), the deviation of the feedback factor FAF indicated by the value FAFA may be inaccurate when the engine speed or the load varies. Under the engine operating conditions in which the engine speed or the load is constant, the correction value FAFA indicates an accurate value of the deviation of the feedback factor FAF. However, in this alternate case in which the correction value FAFA is determined by the equation (11), it is possible for the thus determined value FAFA to indicate an accurate value of the deviation of the feedback factor FAF under any engine operating conditions.

Figure 24:
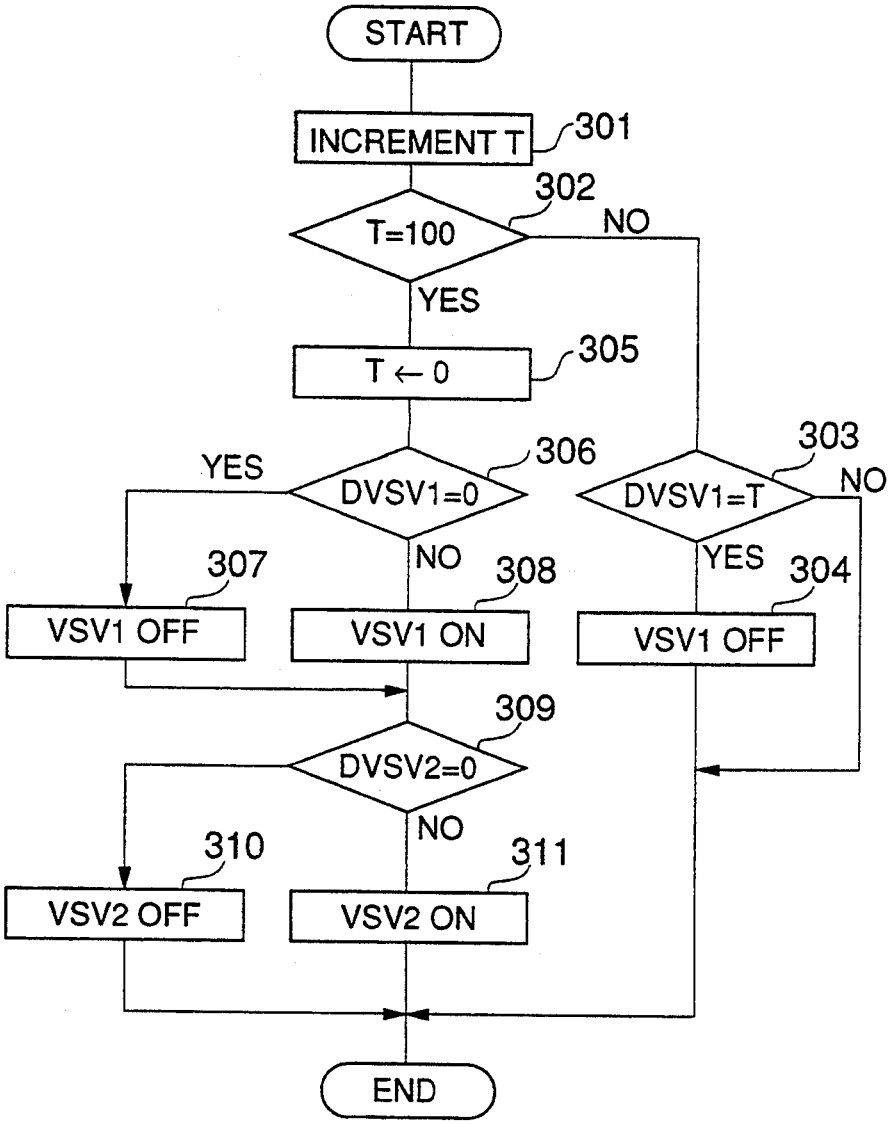
FIG. 24 is a flowchart for explaining a valve switching process provided in the fourth embodiment of the present invention.

Next, a description will be given of a valve switching process provided in the fourth embodiment of the present invention. FIG. 24 shows this valve switching process which is repeatedly performed by the ECU 20 per 1 ms. Several steps 301–302, 304–305, 307–308 and 310–311 of the valve switching process shown in FIG. 24 are the same as the corresponding steps of the process shown in FIG. 4, and a description thereof will be omitted. Only steps 303, 306 and 309 shown in FIG. 24 which are different from the corresponding steps shown in FIG. 4 will now be described.

In the valve switching process shown in FIG. 24, step 306 (corresponding to step S26 in FIG. 4) detects whether or not the value of the control factor DVSV1 provided for the first purge control valve VSV1 is equal to 0. If DVSV1=0, the valve VSV1 is switched OFF. If DVSV1 is not equal to 0, the valve VSV1 is switched ON.

Step 309 (corresponding to step S32 in FIG. 4) detects whether or not the value of the control factor DVSV2 provided for the second purge control valve VSV2 is equal to 0. If DVSV2=0, the valve VSV2 is switched OFF. If DVSV2 is not equal to 0, the valve VSV2 is switched ON. Then, the valve switching process ends.

If the timer count T is not equal to 100 in step 302, step 303 (corresponding to step S38 in FIG. 4) detects whether or not the value of the control factor DVSV1 is equal to the value of the timer count T. If DVSV1=T, the valve VSV1 is switched OFF. If DVSV1 is not equal to 0, the valve switching process ends without switching the valve VSV1 OFF.

According to the fourth embodiment mentioned above, the switching operations of the valves VSV1 and VSV2 are carried out, as shown in FIGS. 5A and 5B, by performing the purge control process in FIG. 18 and the valve switching process in FIG. 24. That is, if the driving duty ratio PGDUTY is smaller than 100, the valve VSV1 is switched 0N during the time period indicated by the PGDUTY in each duty cycle of 100 ms constant and switched OFF during the remaining time period (100−DVSV1) of the duty cycle, and the valve VSV2 is switched OFF during the duty cycle, as shown in FIG. 5A. If the driving duty ratio PGDUTY is greater than 100, the valve VSV1 is switched ON during the time period indicated by the value of (PGDUTY−100) in each duty cycle of 100 ms constant and switched OFF during the remaining time period (100−DVSV1) of the duty cycle, and the valve VSV2 is continuously switched ON during each duty cycle, as shown in FIG. 5B.

The first purge control valve VSV1 is switched 0N and OFF for each duty cycle, but the second purge control valve VSV2 is not always switched. A vacuum switching valve having a response capability that is somewhat low can be used as the valve VSV2. Also, the timing at which an ON state of the valve VSV1 is changed to an OFF state thereof or vice versa is always different from the timing at which an ON state of the valve VSV2 is changed to an OFF state thereof or vice versa, thus preventing the increase of the pulsating flow of evaporated fuel being fed into the intake passage through the valves VSV1 and VSV2. Also, it is unlikely that the evaporated fuel from the canister 11 is fed into a specific cylinder of the engine by the two valves arranged in parallel in the purge passage 16, thus preventing the turbulence of the air-fuel ratio from occurring.

Figure 26:
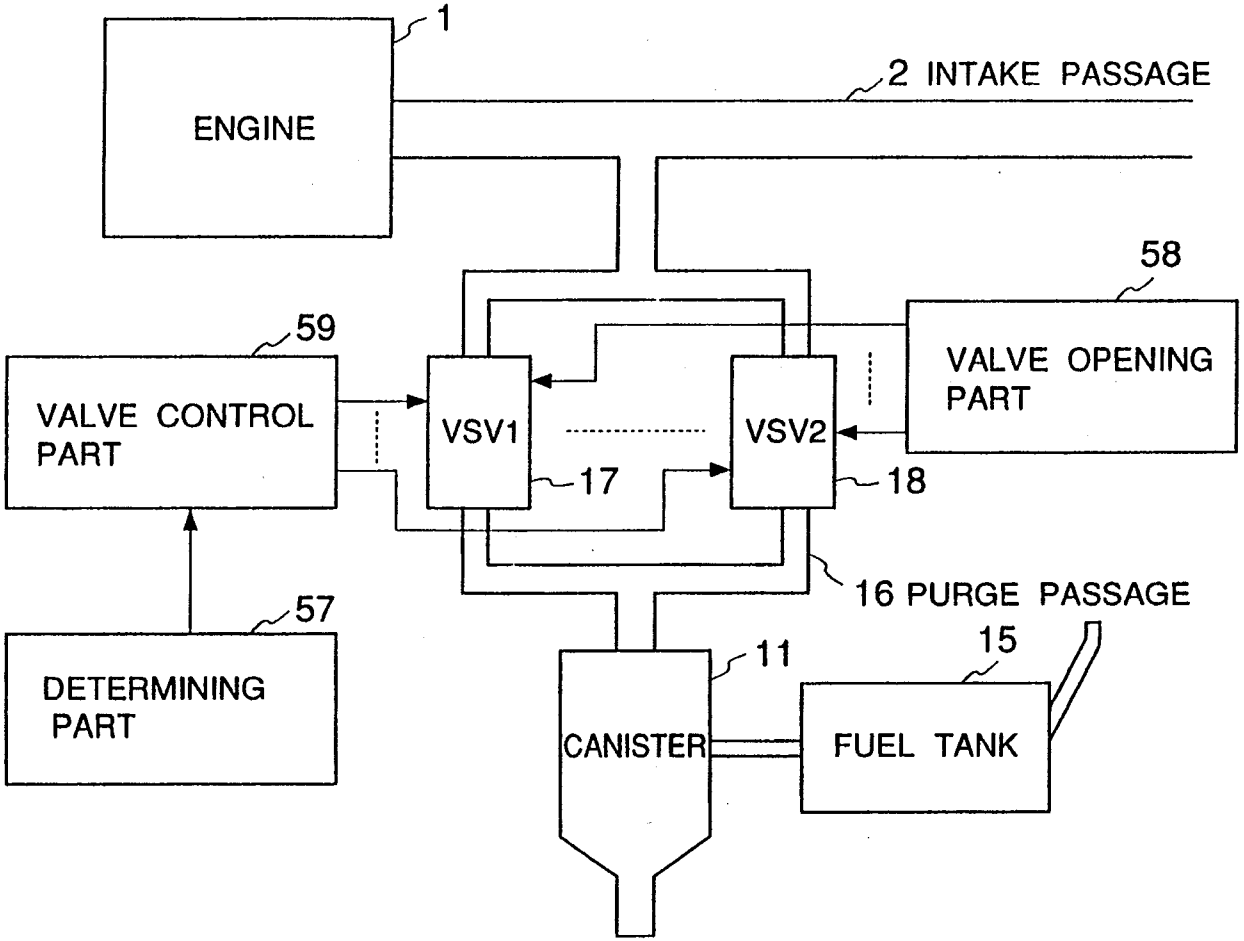
FIG. 26 is a block diagram showing the fourth embodiment of the evaporated fuel purge control apparatus according to the present invention.

FIG. 26 shows the construction of an evaporated fuel purge control apparatus provided in the fourth embodiment of the present invention. In the apparatus shown in FIG. 26, evaporated fuel from the fuel tank 15 is adsorbed by the activated carbon 10 of the canister 11, and the fuel adsorbed in the canister 11 is fed into the intake passage 2 under prescribed operating conditions of the engine 1 through a plurality of purge control valves arranged in parallel in a purge passage between the canister 11 and the intake passage 2. The plurality of purge control valves include at least a first valve (VSV1) being switched on and off by setting a control factor indicating a duty ratio of an on-time within a duty cycle to a total duty-cycle time for the first valve, and a second valve (VSV2) being switched on and off by setting a control factor indicating an on-state or off-state of the second valve for a total duty-cycle time.

The evaporated fuel purge control apparatus shown in FIG. 26 also includes a determining part 57, a valve opening part 58, and a valve control part 59. The determining part 57 determines a factor for each of the plurality of purge control valves, the factor being representative of a flow rate at which evaporated fuel is fed into the intake passage when the purge control valve is opened. The valve opening part 58 carries out switching operations of the valves based on a control factor for each of the first and second valves so that one of the first and second valves is switched on in alternate order at a duty ratio indicated by the control factor. The valve control part 59 controls the switching operations of the valves performed by the valve opening part 58 in a manner that the control factor for the first valve is adjusted, when the first and second valves are opened at the same time, based on the ratio of a factor determined by the determining part 57 for the second valve to a factor determined for the first valve.

In the fourth embodiment of the present invention, the determining part 57 is realized by performing the steps 211–212 shown in FIG. 23B. The valve opening part 58 is realized by performing the steps 105–112 shown in FIG. 18. The valve control part 59 is realized by performing the steps 109–110 and 113–120 shown in FIG. 18 and performing the valve switching process shown in FIG. 24.

Figures 25A, 25B, 25C:
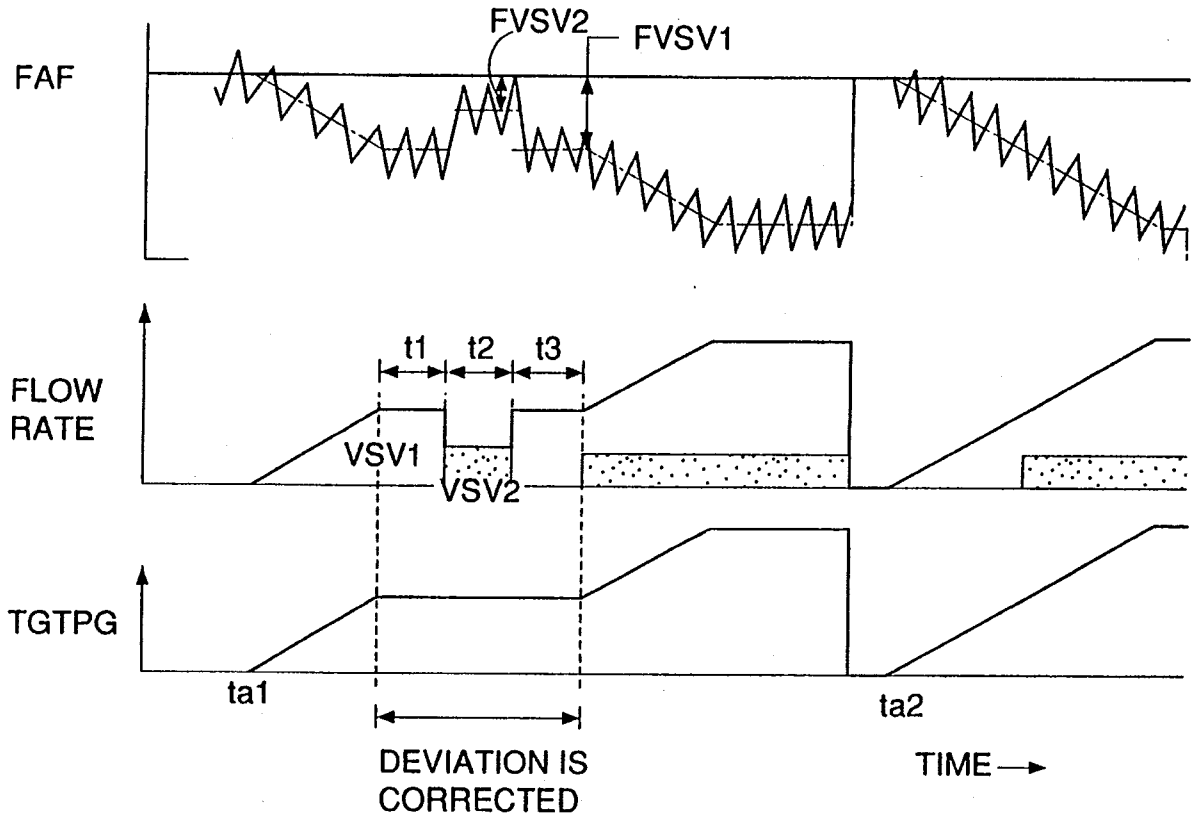
FIGS. 25A, 25B and 25C are timing charts for explaining the changes of the air-fuel ratio feedback factor, the flow rate and the target purge ratio when the processes provided in the fourth embodiment are performed.

FIGS. 25A through 25C show the changes of the air-fuel ratio feedback factor FAF, the flow rate and the target purge ratio TGTPG when the purge control process and the valve switching process provided in the fourth embodiment are performed. Since the purge control process shown in FIG. 18 is repeatedly performed, the value of the target purge ratio TGTPG is gradually increased during an initial portion of a time period starting from a time point "ta1" in FIG. 25C. When the driving duty ratio PGDUTY is increased to the value of 80 or greater, a deviation of the feedback factor FAF is present as shown in FIG. 25A. The target purge ratio TGTPG at this time is maintained at a constant level for a certain time, and the deviation of the FAF is corrected during this time period.

During this time period, the valve VSV1 is solely opened during a first period indicated by an arrow "t1" in FIG. 25B, and the valve VSV2 is solely opened during a second period indicated by an arrow "t2" in FIG. 25B, and the valve VSV1 is solely opened during a third period indicated by an arrow "t3" in FIG. 25B. The FAF correction values FVSV1 and FVSV2 are determined in accordance with the changes of the FAF shown in FIG. 25A, and the correction value VSV0 is determined based on the ratio of the FVSV2 to the FVSV1.

When the driving duty ratio is increased to a value greater than 100 and the two valves VSV1 and VSV2 are opened, the control factors DVSV1 and DVSV2 are corrected using the correction value VSV0. Thus, for s subsequent time period starting from a time point "ta2" in FIG. 25C, it is possible to feed an accurate and stable amount of evaporated fuel into the intake passage through the valves VSV1 and VSV2 by using the thus corrected control factors DVSV1 and DVSV2.

Further, the present invention is not limited to the above described embodiments, and variations and modifications may be made without departing from the scope of the present invention.

What is claimed is:

1. An apparatus for controlling a flow of evaporated fuel from a canister being fed into an intake passage of an engine through a plurality of purge control valves arranged in a purge passage between the canister and the intake passage, said apparatus comprising:

the plurality of purge control valves arranged in parallel in the purge passage between the canister and the intake passage, the purge passage having two outlets into the intake passage with a first one of the plurality of purge control valves controlling flow through one outlet and a second one of the plurality of purge control valves controlling flow through another outlet independently of the first valve, said first valve being switched on and off based on a control factor, the control factor comprising a driving duty ratio value indicating an on-time within a duty cycle of a total duty-cycle time for said first valve, and said second valve being switched on and off based on a control factor indicating one of an on-state and an off-state of the second valve for a total duty-cycle time;

first control means for setting a first control factor for said first valve so that the first valve is switched on and off at a rate indicated by said first control factor, said first control factor comprising a driving duty ratio value indicating an on-time within the duty cycle; and second control means for setting a second control factor for said second valve so that the second valve is switched on and off at a timing different from a timing at which the first valve is switched on and off.

2. An apparatus according to claim 1, wherein said plurality of purge control valves comprise two vacuum switching valves arranged in two branch pipes of the intake passage, each of said pipes connecting the canister to a surge tank of the intake passage.

3. An apparatus according to claim 2, wherein said two vacuum switching valves are electrically operated, independently of each other, by an electronic control unit provided in the engine.

4. An apparatus according to claim 1, wherein said first valve is a vacuum switching valve which is arranged in the purge passage and is electrically operated by an electronic control unit in accordance with the first control factor set by said first control means.

5. An apparatus according to claim 1, wherein said second valve is a vacuum switching valve which is arranged in the purge passage and is electrically operated by an electronic control unit in accordance with the second control factor set by said second control means.

6. An apparatus according to claim 1, wherein, when the driving duty ratio indicating the on-time within the duty cycle is equal to or smaller than a predetermined total duty-cycle time, said first control means sets the first control factor to a value of the driving duty ratio, and said second control means sets the second control factor to a value indicating the off-state of the second valve.

7. An apparatus according to claim 1, wherein, when the driving duty ratio indicating the on-time within the duty cycle is greater than a predetermined total duty-cycle time, said first control means sets the first control factor to a value indicating the driving duty ratio from which the total duty-cycle time is subtracted, and said second control means sets the second control factor to a value indicating the on-state of the second valve.

8. An apparatus for controlling a flow of evaporated fuel from a canister being fed into an intake passage of an engine through a plurality of purge control valves arranged in a purge passage between the canister and the intake passage, said apparatus comprising:

the plurality of purge control valves arranged in parallel in the purge passage between the canister and the intake passage, the purge passage having two outlets into the intake passage with a first one of the plurality of purge control valves controlling flow through one outlet and a second one of the plurality of purge control valves controlling flow through another outlet independently of the first valve, said first valve being switched on and off based on a control factor, the control factor comprising a driving duty ratio value indicating an on-time within a duty cycle of a total duty-cycle time for the first valve, and said second valve being switched on and off based on a control factor, the control factor comprising a driving duty ratio value indicating an on-time within a duty cycle of a total duty-cycle time for the second valve;

first control means for setting a first control factor for said first valve so that the first valve is switched on and off at a rate indicated by said first control factor, said first control factor comprising the driving duty ratio value indicating an on-time within the duty ratio for the first valve; and second control means for setting a second control factor for said second valve so that the second valve is switched on and off at a rate indicated by said second control factor such that said first and second valves are switched on and off in alternate order, said second control factor comprising the driving duty ratio value indicating an on-time within the duty ratio for the second valve.

9. An apparatus according to claim 8, wherein said first and second control means set the first and second control factors in a manner such that the order of switching on and off each of the first and second valves is alternately inverted, and that the order in which the first valve is switched on and off within a duty cycle is opposite to the order in which the second valve is switched on and off within said duty cycle.

10. An apparatus according to claim 8, wherein said first and second control means set the first and second control factors in a manner such that one of the first and second valves is alternately switched on and off and the other valve being switched off for the total duty-cycle time, and that when the driving duty ratio indicating the on-time of said switched-on valve within the duty cycle is greater than the total duty-cycle time a control factor of said switched-on valve is set to a value indicating the total duty-cycle time and a control factor of the other valve being set to a value indicating the driving duty ratio from which the total duty-cycle time is subtracted.

11. An apparatus according to claim 8, wherein the driving duty ratio indicating the on-time of each of the first and second valves within a duty cycle is greater than zero and smaller than twice the total duty-cycle time.

12. An apparatus for controlling a flow of evaporated fuel from a canister being fed into an intake passage of an engine through a plurality of purge control valves arranged in a purge passage between the canister and the intake passage, said apparatus comprising:

the plurality of purge control valves arranged in parallel in the purge passage between the canister and the intake passage, the purge passage having two outlets into the intake passage with a first one of the plurality of purge control valves controlling flow through one outlet and a second one of the plurality of purge control valves controlling flow through another outlet independently of the first valve, said first valve being switched on and off based on a control factor, the control factor comprising a driving duty ratio value indicating an on-time within a duty cycle of a total duty-cycle time for said first valve, and said second valve being switched on and off based on a control factor indicating one of an on-state and an off-state of said second valve for a total duty-cycle time;

determining means for determining a factor representative of a flow rate at which evaporated fuel is fed into the intake passage when one of said purge control valves is being switched on;

valve opening means for carrying out switching operations of the valves based on a control factor for each of said first and second valves so that one of the first and second valves is switched on and off in alternate order at a rate indicated by the control factors; and control means for controlling the switching operations of the valves performed by said valve opening means in a manner such that the control factor is adjusted, when a driving duty ratio indicating an on-time of the first valve within a duty cycle is greater than the total duty-cycle time, based on a ratio of the factor determined by said determining means when only the second valve is being switched on and off and the factor determined by said determining means when only the first valve is being switched on and off.

13. An apparatus according to claim 12, wherein said plurality of purge control valves comprises two vacuum switching valves arranged in two branch pipes of the intake passage, each of said pipes connecting the canister to a surge tank of the intake passage.

14. An apparatus according to claim 13, wherein said two vacuum switching valves are electrically operated, independently of each other, by an electronic control unit provided in the engine.

15. An apparatus according to claim 12, wherein said first valve is a vacuum switching valve which is arranged in the purge passage and is electrically operated by an electronic control unit in accordance with a control factor set by said valve opening means.

16. An apparatus according to claim 12, wherein said second valve is a vacuum switching valve which is arranged in the purge passage and is electrically operated by an electronic control unit in accordance with a control factor set by said valve opening means.

17. An apparatus according to claim 12, wherein said determining means determines said representative factor based on a set of correction values derived through an air-fuel ratio feedback control process performed by an electronic control unit.

18. An apparatus according to claim 12, wherein the total duty-cycle time for the switching operation of said first valve is greater than the total duty-cycle time for the switching operation of said second valve.

* * * * *